US006097924A

United States Patent [19]

Okuyama

[11] Patent Number: 6,097,924

[45] Date of Patent: Aug. 1, 2000

[54] IMAGE FORMING APPARATUS HAVING A SEPARATION DISCHARGER

[75] Inventor: Ushio Okuyama, Ebina, Japan

[73] Assignee: Fuji Xerox Co., Ltd., Tokyo, Japan

[21] Appl. No.: 09/321,710

[22] Filed: May 28, 1999

[30] Foreign Application Priority Data

Jul. 3, 1998 [JP] Japan ..... 10-188434

[51] Int. Cl.[7] ..... G03G 15/14

[52] U.S. Cl. ..... 399/315; 399/44; 399/45; 399/66; 399/92; 399/101; 399/314

[58] Field of Search ..... 399/315, 313, 399/314, 316, 43, 44, 45, 66, 92, 97, 101; 361/220, 222, 214

[56] References Cited

U.S. PATENT DOCUMENTS

| | | | |
|---|---|---|---|
| 4,739,363 | 4/1988 | Hoshika et al. | 399/315 |
| 4,922,303 | 5/1990 | Takeda et al. | 399/92 |
| 5,198,864 | 3/1993 | Fletcher | 399/314 |
| 5,381,216 | 1/1995 | Osaka et al. | 399/315 |
| 5,557,389 | 9/1996 | Sato et al. | 399/315 |
| 5,633,703 | 5/1997 | Takenouchi et al. | 399/315 |
| 5,778,291 | 7/1998 | Okubo et al. | 399/313 X |
| 5,799,226 | 8/1998 | Shigeta et al. | 399/66 |
| 5,822,665 | 10/1998 | Yamamoto et al. | 399/315 X |
| 5,926,683 | 7/1999 | Yuminamochi et al. | 399/315 X |

FOREIGN PATENT DOCUMENTS

| | | |
|---|---|---|
| 3-69977 | 3/1991 | Japan . |
| 5-53412 | 3/1993 | Japan . |
| 6-230681 | 8/1994 | Japan . |
| 7-271200 | 10/1995 | Japan . |
| 9-258565 | 10/1997 | Japan . |

*Primary Examiner*—Sophia S. Chen
*Attorney, Agent, or Firm*—Oliff & Berridge, PLC

[57] ABSTRACT

An image forming apparatus is provided to suppress a separation discharge effectively at a sheet separation time thereby to effectively prevent the disturbance of a toner image on a sheet, as might otherwise be caused due to the separation discharge. The image forming apparatus includes an image carrier for carrying a toner image, a conveyance/transfer unit including at least a sheet conveyor for holding and conveying, for transferring the toner image on the image carrier electrostatically to the sheet, and a sheet separation aiding unit for aiding the action of separating the sheet from the sheet conveyor. The sheet separation aiding unit includes a discharge electrode member arranged downstream of a sheet separating portion of the sheet conveyor and at a position capable of discharging between itself and the sheet conveyor, and a bias applying unit for discharging between the discharge electrode member and the sheet conveyor. The discharged ions, as generated from the discharge electrode member, are fed to the vicinity of the sheet separating portion of the sheet conveyor.

20 Claims, 30 Drawing Sheets

FIG.27

| | |
|---|---|
| △ | BETTER THAN NONE |
| ○− | UNSTABLE EFFECT |
| ○ | STABLE EFFECT |

| APPLIED CURRENT (μA) (ABSOLUTE) | 0 | 5 | 10 | 12.5 | 15 | 20 |
|---|---|---|---|---|---|---|
| MONITOR VOLTAGE (kV) | 0 | 1.7 | 2 | 2.3 | 2.5 | 2.8 |
| EFFECT | △ | △ | ○− | ○− | ○ | ○ |

IMAGE FORMING APPARATUS HAVING A SEPARATION DISCHARGER

BACKGROUND OF THE INVENTION

1. Field of the Invention

The present invention relates to an image forming apparatus such as an electrophotographic copying machine or a printer and, more particularly, to an improvement in the image forming apparatus of the mode in which a toner image on an image carrier is electrostatically transferred to a sheet on a sheet conveyor and in which the sheet is separated from the sheet conveyor.

2. Description of the Related Art

In a color image forming apparatus of the so-called "tandem type", as known in the prior art, multiple image forming units (adopting the electrophotographic method, for example) are arranged a sheet conveying passage extending in a horizontal direction, for example, so that toner images are sequentially transferred from the individual image forming units to a sheet (a transfer material such as paper or OHP sheet) moving along the sheet conveying passage to form a color image on the sheet.

As the sheet conveying method of the color image forming apparatus of this kind, there has already been proposed (as referred to Unexamined Published Japanese Patent Application No. 5-53412, for example) a belt conveyor method in which a conveyor belt circulating along the sheet conveying passage is provided, for example, for adsorbing and holding a sheet electrostatically on the conveyor belt.

Here in the tandem type color image forming apparatus of this kind, the conveyor belt is made to run on a plurality of (e.g., two) tension rolls, and the running portion of the conveyor belt on the tension rolls is formed into a branch passage curved with respect to the linear sheet conveying passage so that the sheet on the conveyor belt is naturally separated by using a portion of the running portion of the conveyor belt on the tension roll as a sheet separating portion.

At this time, when the sheet is to be separated from the conveyor belt, the so-called "separation discharge" occurs at the separation portion between the sheet and the conveyor belt. As a result, the charge state on the back face of the sheet abruptly changes to raise a technical problem that the toner on the sheet disperses.

Especially in the tandem type image forming apparatus adopting the belt conveyor method, the sheet is electrostatically adsorbed by the conveyor belt, and the sheet and the conveyor belt are sequentially charged at a transfer step by the individual image forming units. As a result, the sheet and the conveyor belt are liable to be highly charged to cause the aforementioned toner dispersion phenomenon seriously.

In order to solve this technical problem, there can be enumerated a method in which a destaticizing member is arranged on the back side of the conveyor belt and in front of and in contact with the sheet separating portion to reduce the charge of the conveyor belt. Even if this method is adopted, a toner image in a charged state is carried on the sheet, and the charged state of the conveyor belt can not be completely eliminated. The cause for the separation discharge still remains when the sheet is to be separated from the conveyor belt, so that the separation discharge at the sheet separating time is not completely eliminated.

In order to solve this technical problem, there has already been proposed a technique (as referred to Unexamined Published Japanese Patent Application No. 7-271200, for example) in which an electrically grounded conductive guide plate is arranged in the vicinity of the sheet separating portion of the conveyor belt and within a range of 5 mm with respect to the conveyor belt so that the charge on the sheet may be slowly discharged through the conductive guide plate to prevent the separation discharge at the sheet separation time.

In this time, too, the sheet separating portion on the conveyor belt and the conductive guide plate are arranged at a spacing. At the start of the sheet separation, therefore, the separation discharge may occur by the time the leading edge of the sheet comes into contact with the conductive guide plate so that the technique is still insufficient for eliminating the toner dispersion phenomenon by the separation discharge.

As shown in FIG. 30, on the other hand, there has already been known a technique (as referred to Unexamined Published Japanese Patent Application No. 6-230681 or Unexamined Published Japanese Patent Application No. 9-258565, for example). In an image forming apparatus of the mode in which a transfer roll 302 (for applying a transfer bias 303) is arranged in forced contact with a drum-shaped photosensitive member 301, for example, in order to prevent the phenomenon in which a sheet 306 having passed through the nipping region between the photosensitive member 301 and the transfer roll 302 sticks to the photosensitive member 301, a sheet discharging electrode 304 having saw teeth, for example, for discharging the back face of the sheet 306 is arranged in the vicinity of the downstream of the nipping region, and a predetermined bias 305 is applied to the sheet discharging electrode 304 to cause the discharge between the sheet 306 and the sheet discharging electrode 304 thereby to destaticize the sheet 306, so that the electrostatic adsorption of the sheet 306 to adsorb the photosensitive member 301 is eliminated to separate the sheet 306 from the photosensitive member 301.

According to these techniques, however, the back face of the sheet 306 is destaticized to separate the sheet 306, as having stuck to the side of the photosensitive member 301. In the aforementioned belt conveyor type image forming apparatus, however, the sheet passes through the photosensitive member portions of the individual image forming units while being electrostatically adsorbed by the conveyor belt. From the standpoint of preventing the stick to the photosensitive member, therefore, it is intrinsically of little necessity to arrange the aforementioned sheet discharging electrode 304.

If this sheet discharging electrode 304 is to be arranged, in the mode in which the sheet discharging electrode is arranged on the surface side of the sheet, the toner image on the sheet surface is directly disturbed by the discharge from the sheet discharging electrode. In the mode in which the sheet discharging electrode is arranged on the back side of the sheet, the presence of the conveyor belt makes it difficult to destaticize the sheet so that the separation discharge to be caused when the sheet is separated from the conveyor belt cannot be eliminated to make it difficult to prevent the toner dispersion from occurring at the separation.

In order to solve this technical problem, it is conceivable to provide the aforementioned belt conveyor type image forming apparatus, for example, with the sheet discharging electrode downstream of the sheet separating portion of the conveyor belt and on the back side of the sheet so that the discharge may be caused between the sheet and the sheet discharging electrode to destaticize the sheet.

In this mode, however, the separation discharge at the sheet separating time may be reduced, but the toner dispersion may be caused by the discharge between the sheet and the sheet discharging electrode.

Here, this technical problem should not be limited to the aforementioned belt conveyor type image forming apparatus but will also occur in the image forming apparatus of the mode in which the transfer roll is arranged in forced contact with a drum-shaped photosensitive member, for example. In the image forming apparatus of the mode in which the transfer roll is arranged in forced contact with the drum-shaped photosensitive member, more specifically, the separation discharge occurs when the sheet having passed through the nipping region between the photosensitive member and the transfer roll is separated from the transfer roll, and the toner dispersion may occur on the sheet.

SUMMARY OF THE INVENTION

The invention has been conceived to solve the foregoing technical problems and to provide an image forming apparatus which can suppress a separation discharge effectively at a sheet separation time thereby to effectively prevent the disturbance of a toner image on a sheet, as might otherwise be caused due to the separation discharge.

According to one aspect of the invention, more specifically, there is provided an image forming apparatus that has an image carrier for carrying a toner image, a conveyance/transfer unit including at least a sheet conveyor for holding and conveying, for transferring the toner image on the image carrier 1 electrostatically to the sheet, and a sheet separation aiding unit for aiding the action of separating the sheet from the sheet conveyor. The sheet separation aiding unit includes a discharge electrode member arranged downstream of a sheet separating portion SP of the sheet conveyor and at a position capable of discharging between itself and the sheet conveyor, and a bias applying unit for discharging between the discharge electrode member and the sheet conveyor. The discharged ions, as generated from the discharge electrode member, are fed to the vicinity of the sheet separating portion of the sheet conveyor.

In this apparatus, the image carrier may be any if it can carry at least the toner image, and may be made of a suitable material selected from a photosensitive material or a dielectric material. The image carrier may be formed into a drum or belt shape or may be provided in one or more as in the tandem type image forming apparatus.

Moreover, the image carrier should not be limited to the mode in which it is composed of an image forming carrier forming and carrying the toner image, but may include a mode in which it is composed of the image forming carrier and an intermediate transfer member for transferring the toner image on the image carrier temporarily thereto before to the sheet.

As a representative mode of the conveyance/transfer unit, on the other hand, there can be enumerated a mode in which the unit includes a sheet conveyor for holding and conveying the sheet, and a transfer member arranged to confront the image carrier on the back side of the sheet conveyor for transferring the toner image on the image carrier toward the sheet. However, the representative mode should not be limited thereto but may include a mode in which the sheet conveyor of the conveyance/transfer unit is arranged in contact with the image carrier to hold and convey the sheet and acts as a transfer member for transferring the toner image on the image carrier to the side of the sheet.

Here as to the conveyance/transfer unit of the mode in which the sheet conveyor and the transfer member are separated, the transfer member is sufficient if it is arranged on the back side of the sheet conveyor, but it is not required whether or not the transfer member is in contact with the back face of the sheet conveyor. Therefore, the transfer member may be either a contact type transfer member such as a transfer roll for nipping the sheet conveyor between itself and the image carrier or a non-contact type transfer member such as the corotron.

On the other hand, the conveyance/transfer unit of the mode using the sheet conveyor and the transfer member is required to use a contact type transfer member such as a transfer roll to contact with the image carrier.

Moreover, the sheet conveyor has to realize the function to convey the sheet within a range to raise no trouble in the transferring action and is preferred to have a volume resistivity of 5 to 14 logohms, for example.

Here, if the volume resistivity exceeds 14 logohms, it is not preferable for realizing the transfer actions to make the supply capacity of the transfer bias excessive and to make the transfer defect liable to occur. Under 5 logohms, on the other hand, it is not preferable for the unstable transfer actions at the individual transfer portions to make the time constant of the charge attenuation of the sheet conveyor excessively small.

On the other hand, the discharge electrode member of the sheet separation aiding unit is attached to the image forming apparatus body through a bracket but may be exemplified by a mode, in which the discharge electrode member is arranged out of contact with the sheet conveyor, or a mode in which the discharge electrode member is arranged in contact with the sheet conveyor.

In the mode in which the discharge electrode member is arranged in contact with the sheet conveyor, however, a portion of the discharge electrode member has to be made of an insulating member, through which it is arranged in contact with the sheet conveyor.

As to the layout of the discharge electrode member, moreover, this discharge electrode member may be arranged to confront the sheet conveyor at a dischargeable position between itself and the sheet conveyor but is preferably arranged at a position to establish the discharge mainly between itself and the sheet conveyor but not the sheet. At this time, the discharge electrode member may be so spaced as to suppress the discharge between itself and the sheet or may be equipped at its portion on the side of the sheet with an insulating member to suppress the discharge between itself and the sheet.

As to the layout of the discharge electrode member, on the other hand, this discharge electrode member may be arranged downstream of the sheet separating portion of the sheet conveyor but is preferably arranged as close to the sheet separating portion as possible from the standpoint of enhancing the feed of the discharged ions to the sheet separating portion.

As shown in FIG. 1, specifically, in the mode in which the sheet conveyor 3 is ordinarily provided with a curved portion 3*a* (i.e., the portion made to run on a tension roll 3*b* in FIG. 1 but the curved portion of the transfer roll itself in the mode in which the sheet conveyor 3 acts as the transfer member 4 or in the transfer roll construction) having an arcuate section on the downstream side of the sheet separating portion SP, the discharge electrode member 7 may be arranged to confront the curved portion 3*a* at an angle within 90 degrees from the sheet separating portion of the sheet conveyor 3.

In this case, at least a portion of the discharge electrode member 7 is arranged within a wedge region which is formed between the sheet 5 separated at the sheet separating portion SP of the sheet conveyor 3 and the curved portion 3*a* of the sheet conveyor 3.

In the mode in which the discharge electrode member 7 is arranged at a spacing from the sheet separating portion SP, too, there can be added an air outflow unit for moving the discharged ions, as generated from the discharge electrode member 7, forcibly with an air flow thereby to retain the feedability of the discharged ions to the vicinity of the sheet separating portion SP.

Moreover, the positioning of the discharge electrode member 7 may be suitably selected, but it is preferred from the standpoint of stabilizing the discharging action of the discharge electrode member 7 to provide a tracking member for retaining a dischargeable gap between the discharge electrode member 7 and the sheet conveyor 3.

Here, the tracking member is exemplified either by a mode, in which a spacer made of an insulating member and having a predetermined thickness is provided in a portion of the discharge electrode member 7 and interposed between the discharge electrode member 7 and the sheet conveyor 3, or by a mode in which the discharge electrode member 7 is attached to a position actuator so that the position of the discharge electrode member 7 may be set by driving the position actuator suitably.

On the other hand, the discharge electrode member 7 is a functional member for establishing the discharge between itself and the sheet conveyor 3 but may be constructed to act as another functional member.

For example, the discharge electrode member 7 ma y be equipped with a guide member for guiding and conveying the sheet 5 which is separated at the sheet separating portion SP of the she et conveyor 3.

In this case, the guide member may be made of either an insulating member or a conductive member.

On the other hand, the specific construction of the discharge electrode member 7 may be suitably selected if it is equipped with a functional member which extends in a sheet widthwise direction perpendicular to the sheet conveying direction of the sheet conveyor for establishing the discharge substantially homogeneously with respect to the sheet widthwise direction.

This construction may be enumerated by a flat or sawtooth metal plate, a metal wire or a dielectric film.

As to the position of the discharge electrode member 7, moreover, there is enumerated a mode in which the discharge electrode member 7 is uniquely fixed at a predetermined position. However, the positioning should not be limited thereto, but means for making variable the discharging conditions by the discharge electrode member 7 may support the discharge electrode member 7 movably by the position actuator or the like to set the arrangement position of the discharge electrode member 7 variable.

On the other hand, the bias applying unit of the sheet separation aiding unit may be suitably selected if it applies a discharge bias to set the sheet conveyor at the polarity reversed from that of the toner.

When the toner is at the negative polarity, for example, the sheet conveyor may be set at a higher potential than that of the discharge electrode member. This setting may be suitably selected by applying a positive polarity bias to the sheet conveyor while grounding the discharge electrode member to the earth, by applying a negative polarity bias to the discharge electrode member while grounding the sheet conveyor to the earth, or by applying a positive polarity bias to the sheet conveyor while applying a negative polarity bias to the discharge electrode member.

In this case, the bias applying unit may adopt either a constant current control or a constant voltage control as the applied bias, but the bias may be set variable as means for changing the discharging conditions by the discharge electrode member.

Moreover, the bias applying unit may be provided especially for establishing the discharge by the discharge electrode member. From the standpoint of lowering the cost for the apparatus, it is preferred to share the bias to be applied to a functional member other than the discharge electrode member.

For example, it may be arbitrarily selected to share (or use at the time of the sheet adsorption OFF) the sheet adsorbing power supply for the sheet conveyor to adsorb the sheet electrostatically, to share a transferring power supply, or to share a cleaner power supply for the sheet conveyor.

As to the application timing of the bias of the bias applying unit, still moreover, the bias may be applied within a range to prevent the toner dispersion which might otherwise accompany the separation discharge to occur at the separation time of the sheet. While at least an image region (or toner image carrying region) on the sheet is passing over the sheet separating portion of the sheet conveyor, the bias may be applied at the timing in which the discharged ions, as generated by the discharge electrode member, are fed to the vicinity of the sheet separating portion.

If the bias is applied at the timing in which the discharged ions, as generated by the discharge electrode member, are fed to the vicinity of the sheet separating portion while at least the image region on the sheet and the leading edge portion of the sheet are passing over the sheet separating portion of the sheet conveyor, it is more preferable to keep the separability of the sheet satisfactory to an extent to reduce the charge of the leading edge of the sheet.

As to the timing of applying the bias of the bias applying unit, on the other hand, the bias is basically applied at the time of separating the sheet but should not be limited thereto. The bias may be applied for another purpose.

In the mode in which there is provided a sheet conveyor cleaner for cleaning the residual toner on the sheet conveyor by applying a bias at the polarity reversed from that of the toner to the cleaning member, for example, the bias applying unit is exemplified by applying the bias to discharge the residual toner on the sheet conveyor 3 by the discharge electrode member at the action time of the sheet conveyor cleaner.

Here, the residual toner is left on the sheet conveyor, (1) when the fog toner on the image carrier sticks to the sheet conveyor at the time of transferring the sheet of a small size, (2) when there is adopted a system in which a density detecting patch is formed on the image carrier and transferred to the sheet conveyor so that the patch density may be detected by a density sensor, and (3) when the sheet is not conveyed to the sheet conveyor by a mistaken feed so that the toner image on the image carrier is erroneously transferred to the sheet conveyor.

In these modes, the residual toner on the sheet conveyor rises in its charge (or tribo-value) so that it changes into a state in which it is liable to be transferred to the sheet conveyor cleaner, so that the cleaning performance by the sheet conveyor cleaner is kept satisfactory.

On the other hand, the sheet separation aiding unit of the invention may always act at least when the sheet is separated, but should not be limited thereto. The sheet separation aiding unit may be suitably controlled,if necessary.

For example, it is possible to enumerate a mode in which there is provided a controller for controlling the discharge by the discharge electrode member in accordance with the environmental conditions.

In this case, it is preferable from the standpoint of omitting the spare sheet separation aiding action to embody the controller into an environment detecting unit for detecting whether or not the environment is at a low moisture in which the resistance of the sheet becomes higher than the standard level, so that the discharge may be established by the discharge electrode member under the condition where the detection data from the environment detecting unit are in the low moisture environment.

On the other hand, it is arbitrary to set variable the bias to be applied from the bias applying unit in accordance with the environmental conditions, or to change the discharge level by the discharge electrode member by setting the position of the discharge electrode member variable.

When the kind or the separation position of the sheet changes, on the other hand, the ordinary sheet separating portion changes. In the mode in which the discharging conditions by the discharge electrode member are constant, therefore, there arises a situation in which the state of feeding the discharged ions to the vicinity of the sheet separating portion becomes different.

Therefore, a mode for avoiding such situation effectively is exemplified by one in which there is provided the controller for controlling the discharge by the discharge electrode member in accordance with the kind or the separation position of the sheet.

In this case, the controller is specified by a sheet data detecting unit for detecting the kind or the separation position of the sheet, so that the discharging conditions by the discharge electrode member may be optimized by specifying the sheet separating portion in accordance with the detection data from the sheet data detecting unit or by setting variable the bias, as fed from the bias applying unit.

On the other hand, here will be supplemented the prior art examples which look, at a glance, similar to the sheet separation aiding unit of the invention.

In Unexamined Published Japanese Patent Application No. 6-230681, for example, it is disclosed, in an image forming apparatus for transferring a toner image on a drum-shaped photosensitive member to a transfer member by a contact type transfer roller, that a discharge member having a sharp end is arranged to confront the transfer member and the transfer roller to establish the discharge for the transfer member and the transfer roll.

Although it can be surely said that the point of establishing the discharge between the discharge member and the transfer roller is shared with the invention, the "discharging action between the discharge member and the transfer roller" in the prior art examples is intended to clean the toner having stuck to the transfer roller. This cleaning is performed at no paper passage in which the transfer member (corresponding to the sheet of the present invention) does not pass through the transfer portion, so that the polarity of the reversely charged toner is reversed with the discharge at the same polarity as that of the toner to remove the toner by the repulsion to the transfer roller (corresponding to the sheet conveyor of the present invention).

Unlike the invention, therefore, the prior art examples have indicated neither the technical problem of the toner dispersion, as caused by the separation discharge at the sheet separation time, nor the "sheet separation aiding unit for feeding the discharged ions to the vicinity of the sheet separating portion" acting as the means for solving that technical problem.

In Unexamined Published Japanese Patent Application No. 3-69977 presenting another prior art example, on the other hand, there has already been proposed an image forming apparatus which includes an image carrier and a transfer belt made to run on a tension roll in synchronism with the image carrier while holding and transferring a transfer member. In this image forming apparatus, a bias voltage is applied to the tension roll on the side for the sheet to be separated from the transfer belt, and a destaticizing brush and a destaticizing needle are arranged to abut against the transfer belt in the vicinity of the separating portion of the transfer member.

Since the transfer belt is destaticized by applying a predetermined bias voltage to the tension roll, according to the prior art example, the action of the transfer belt to adsorb the transfer member can be attenuated to suppress the separation discharge effectively thereby to suppress the image quality deterioration, as might otherwise be caused by the dispersion of the toner. It has been disclosed that the destaticizing action is more promoted especially by adding the destaticizing brush or the like.

It can be surely said that this prior art example has a technical problem shared with the invention because it has been conceived under the technical problem or the image quality deterioration, as caused by the toner dispersion accompanying the separation discharge at the separating time of the transfer member.

However, the "means for applying the bias to the tension roll" and the "destaticizing brush or the like" of this prior art example is nothing but the functional member for destaticizing the transfer belt (corresponding to the sheet conveyor of the present invention) but is different in the fundamental concept from the "discharge electrode member" and the "bias applying unit" of the invention for the discharge between itself and the sheet conveyor in the point of feeding the discharged ions to the vicinity of the sheet separating portion.

Although this prior art example could destaticize the transfer belt to some extent, moreover, the toner image in the charged state is carried on the side of the transfer member (corresponding to the sheet of the present invention). As a result, there still remains a cause for establishing the separation discharge when the transfer member is to be separated from the conveyor belt, and the separation discharge at the sheet separation time may not be completely eliminated.

Therefore, it can be said that the invention and the prior art example are absolutely different in the method for and degree of solving the technical problem.

Here will be described the actions of the aforementioned technique.

The sheet separation aiding unit according to the invention is constructed, as shown in FIG. 1, to include the discharge electrode member 7 arranged downstream of the sheet separating portion SP of the sheet conveyor 3 and at a position to establish the discharge between itself and the sheet conveyor 3, and the bias applying unit 8 for establishing the discharge between the discharge electrode member 7 and the sheet conveyor 3.

Now, it is assumed that a plurality polarity toner images T1 and T2, for example, are formed on the sheet 5, as shown in FIG. 2, and that the bias applying unit 8 applies a negative polarity bias VB to the side of the discharge electrode member 7, for example, and grounds the sheet conveyor 3 to the earth.

When the bias applying unit 8 applies the bias VB under this situation, the discharge is established between the discharge electrode member 7 and the sheet conveyor 3, as shown in FIG. 2, + ions are generated from the surface of the sheet conveyor 3 whereas − ions are generated from the discharge electrode member 7, so that these + and − ions fly in the individual directions.

Then, the positive and negative ions thus generated are present to the vicinity of the sheet separating portion SP, where they stick to the back face of the sheet 5 and to the surface of the sheet conveyor 3, respectively, to cause an electric neutralization.

As a result, the back face of the sheet 5 and the surface of the sheet conveyor 3 are homogeneously destaticized to make it reluctant for the separation discharge to occur between the sheet 5 and the sheet conveyor 3.

At the separation time of the sheet 5, therefore, the separation discharge is lightened so that the toner dispersion, as caused according to the separation discharge, is accordingly effectively suppressed.

BRIEF DESCRIPTION OF THE DRAWINGS

FIG. 27 is an explanatory diagram tabulating the results which have examined the relations between an applied bias (e.g., current and voltage values) and a toner dispersion phenomenon at a toner separating time;

DESCRIPTION OF THE PREFERRED EMBODIMENTS

This invention will be described in detail in connection with its embodiments with reference to the accompanying drawings.

[Embodiment 1]

Figure 1:
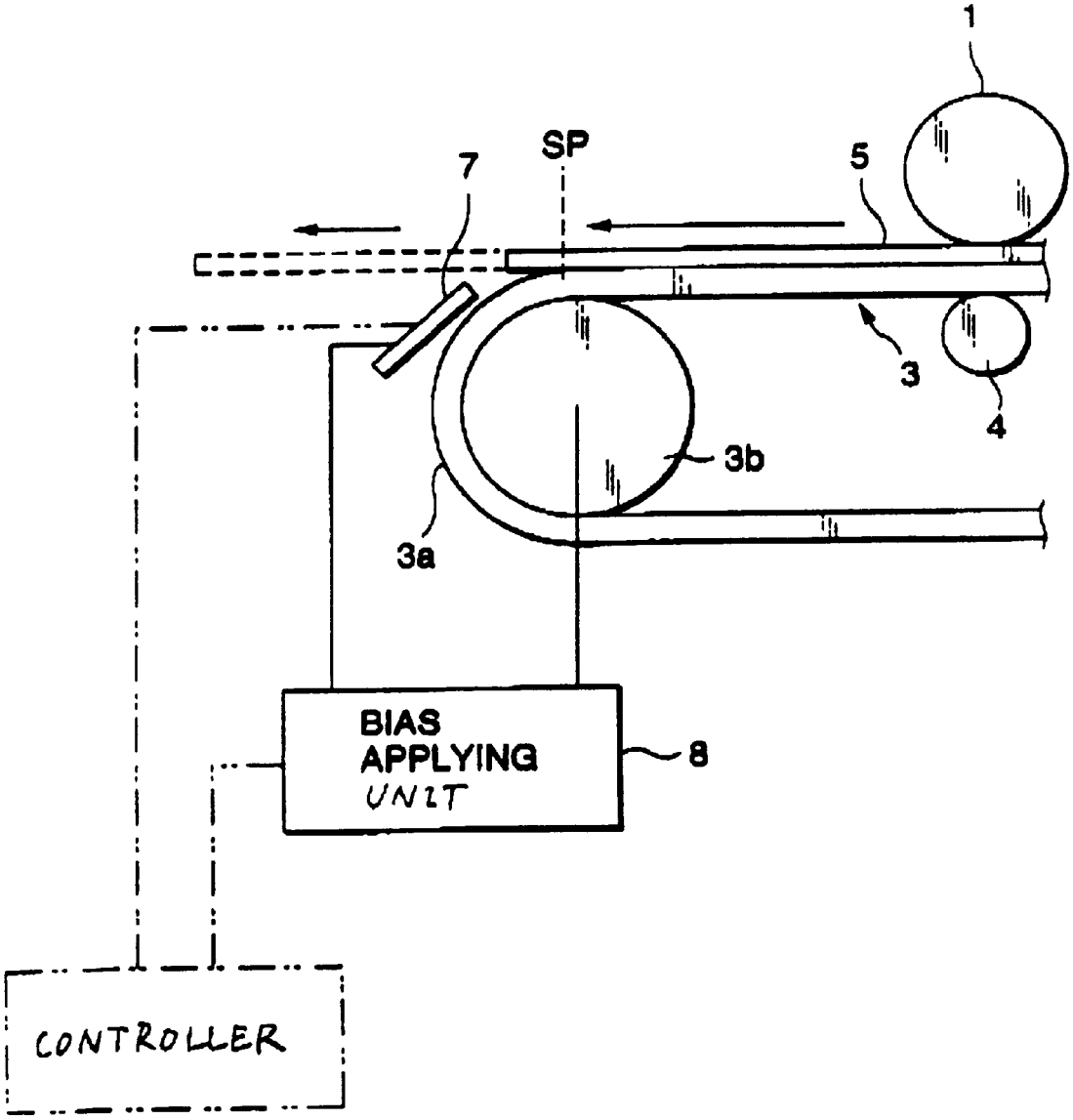
FIG. 1 is an explanatory diagram showing a fundamental construction of an image forming apparatus according to the invention.
Figure 2:
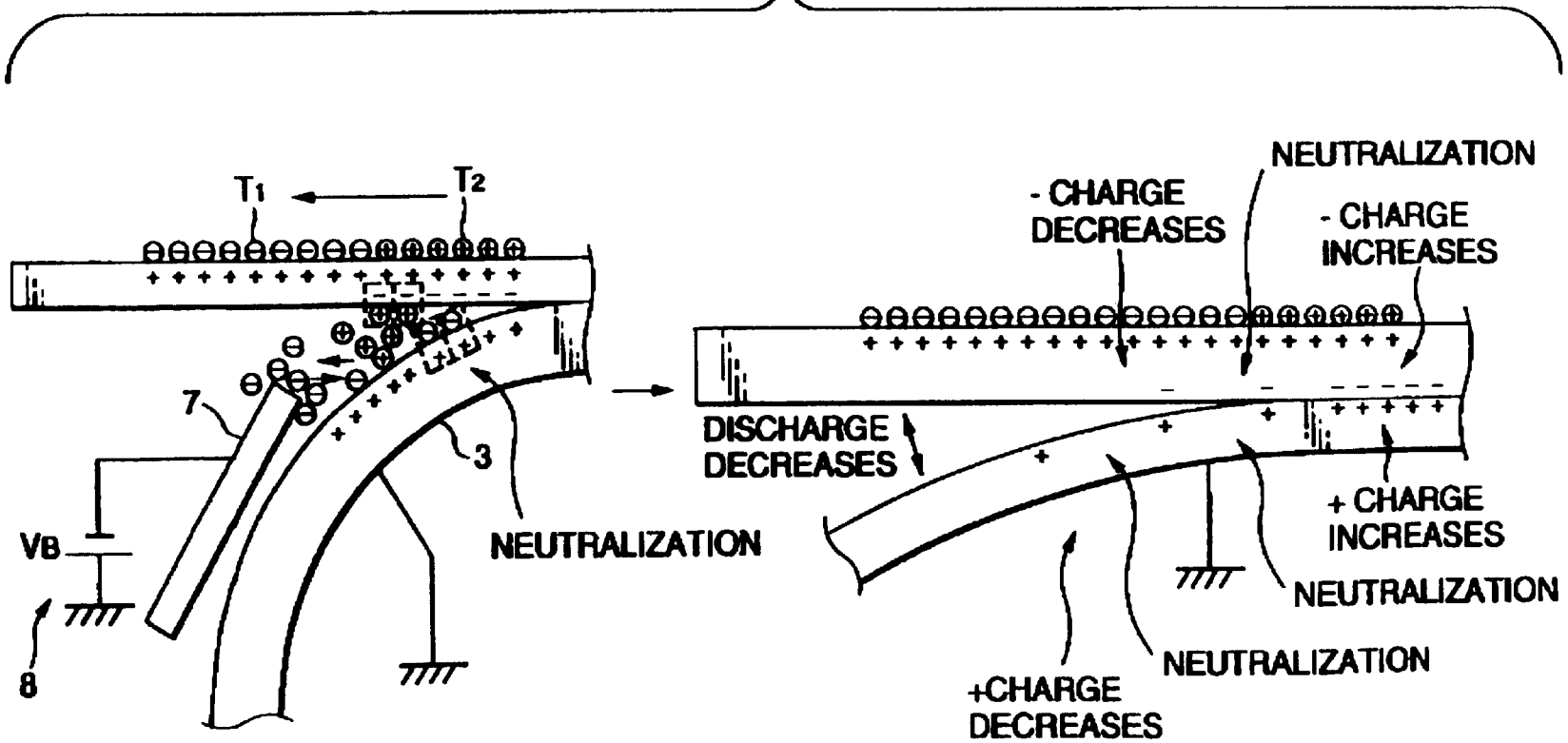
FIG. 2 is an explanatory view showing the actions of a sheet separation aiding unit according to the invention.
Figure 3:
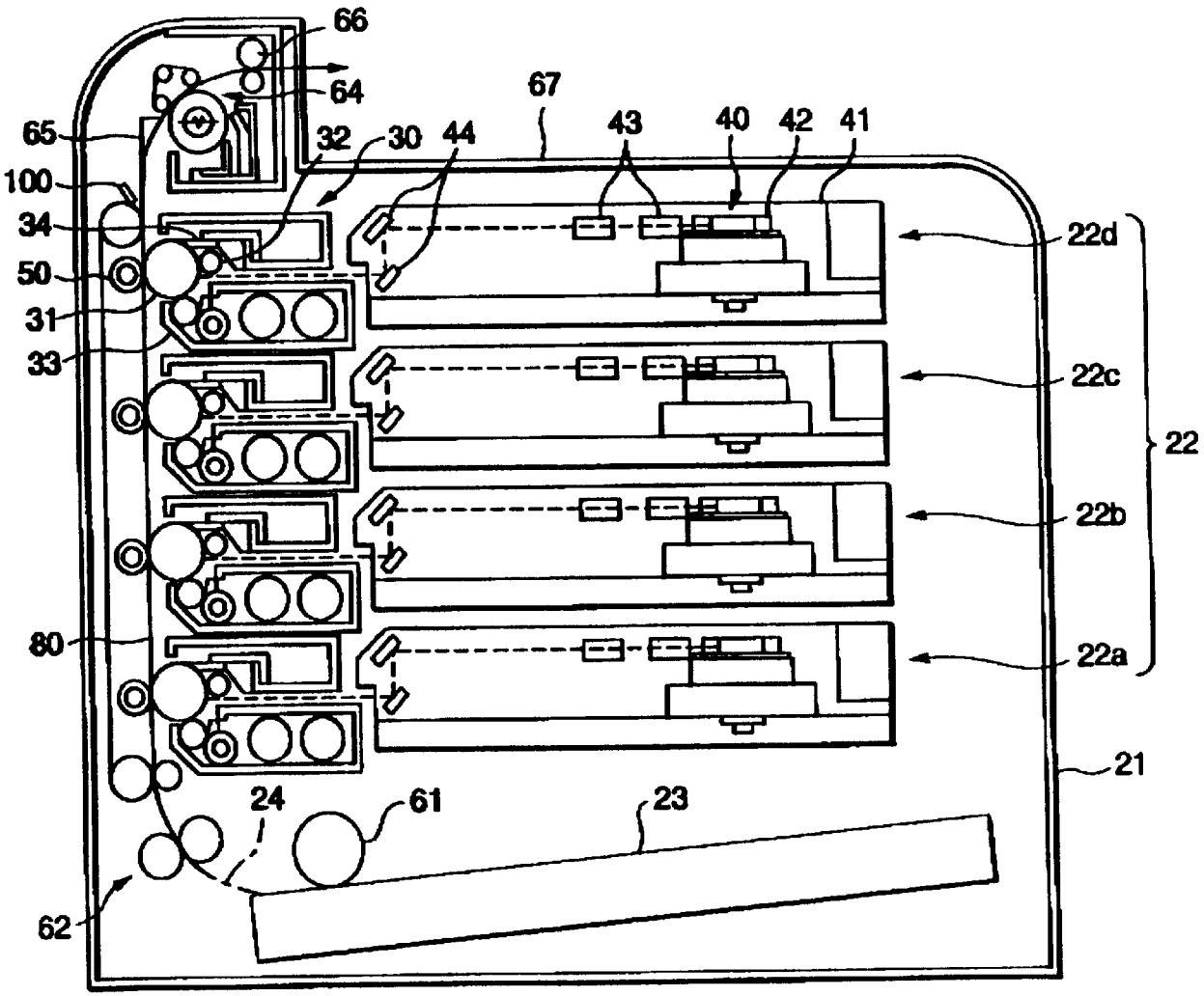
FIG. 3 is an explanatory diagram showing Embodiment 1 of the image forming apparatus to which the invention is applied.

FIG. 3 shows Embodiment 1 of a color image forming apparatus to which the invention is applied.

In the color image forming apparatus, as shown in FIG. 3, there are vertically arranged in a body housing 21 image forming units 22 (e.g., 22*a* to 22*d*) of four colors (i.e., black, yellow, magenta and cyan in this embodiment). Below the image forming units 22, there is arranged a sheet feeding cassette 23 for reserving sheets (e.g., sheets of paper or OHP sheets) to be fed. At positions corresponding to the individual image forming units 22, there is vertically arranged a sheet conveying passage 24 acting as a passage for conveying the sheets coming from the sheet feeding cassette 23.

In this embodiment, the image forming units 22 (22*a* to 22*d*) form black, yellow, magenta and cyan toner images in this sequence from the upstream of the sheet conveying passage 24, and are individually equipped with a photosensitive cartridge 30 and an exposure unit 40.

Here, the photosensitive cartridge 30 is integrated, for example, from: a photosensitive drum 31; a charging roll 32 for charging the photosensitive drum 31 in advance; a developer 33 for developing an electrostatic latent image, as exposed and formed on the charged photosensitive drum 31 by the exposure unit 40, with a corresponding color toner (of a negative polarity, for example, in this embodiment); and a cleaner 34 for removing the residual toner from the photosensitive drum 31.

On the other hand, the exposure unit 40 cases the not-shown semiconductor laser, a polygonal mirror 42, a focusing lens 43 and a mirror 44 in a case 41, and deflects and scans the optical beam, as coming from the not-shown semiconductor laser, with the polygonal mirror 42 to guide the optical image through the focusing lens 43 and the mirror 44 on an exposure point on the photosensitive drum 31.

Figure 4:
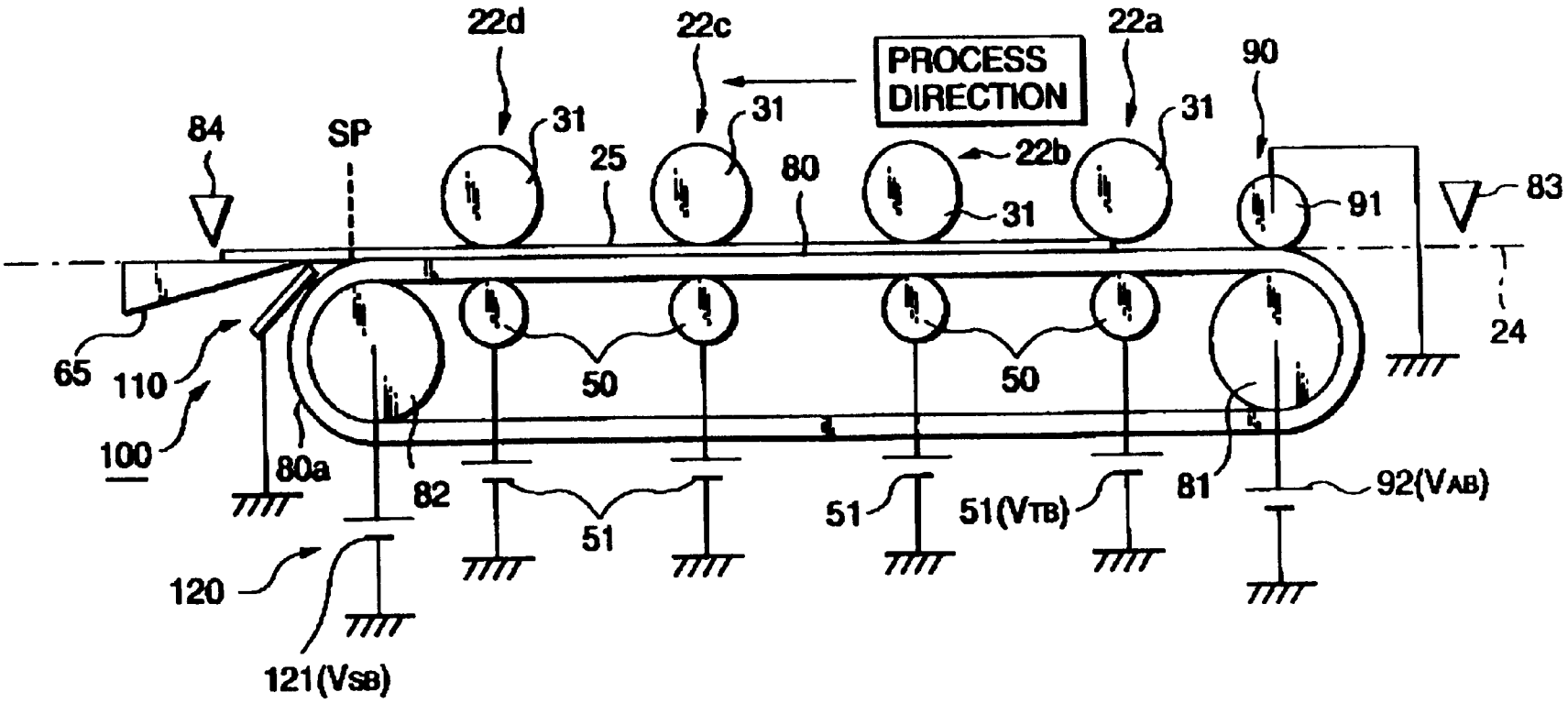
FIG. 4 is an explanatory diagram showing the neighborhood of a sheet conveying line to be used in the image forming apparatus according to Embodiment 1.

In this embodiment, on the other hand, in the portion corresponding to each photosensitive drum 31 of each image forming unit 22, there is arranged a conveyor belt 80 for circulatively moving along the sheet conveying passage 24, as shown in FIGS. 3 and 4.

The conveyor belt 80 is made of a belt material (e.g., rubber or resin) capable of adsorbing a sheet 25 (as referred to FIG. 4) electrostatically to have a volume resistivity of about 5 to 14 logohms and may be formed of a single layer or a plurality of layers.

Moreover, this conveyor belt 80 is made to run on a pair of metallic tension rolls 81 and 82. In this embodiment, the upper tension roll 82 acts as a drive roll whereas the lower tension roll 81 acts as a driven roll.

On the back side of the conveyor belt 80 corresponding to the photosensitive drum 31 of each image forming unit 22, moreover, there is arranged a transfer rolls 50 (of 3 to 9 logohms in this embodiment), so that the sheet 25 on the conveyor belt 80 is nipped and held by the transfer rolls 50 and the photosensitive drums 31. With the transfer rolls 50, moreover, there are connected transfer bias power supplies 51 to apply a predetermined transfer bias VTB (of a positive polarity of +700 V, for example, in this embodiment) at a suitable timing.

In this embodiment, still moreover, a sheet adsorbing unit 90 is arranged at the entrance portion of the conveyor belt 80, as shown in FIGS. 3 and 4.

In this sheet adsorbing unit 90, an absorption roll 91 is arranged in forced contact with the portion, as corresponding to the entrance side tension roll 81 of the conveyor belt 80, of the sheet conveying passage 24, and an absorption bias power supply 92 is connected with the tension roll 81 to apply an absorption bias VAB (at +1,000 V in this embodiment) of the same polarity as that of the transfer bias VTB at a suitable timing but to ground the absorption roll 91 to the earth.

In this embodiment, on the other hand, the sheet feeding cassette 23 is equipped with a feed roll 61 for feeding the sheet 25 at a predetermined timing. Conveyor rolls 62 for conveying the sheet is disposed in the sheet conveying passage 24 which is positioned between the feed roll 61 and the transfer portion of the most upstream image forming unit 22*a*.

In the sheet conveying passage 24 which is located downstream of the most downstream image forming unit 22*d*, moreover, there is disposed a fixing unit 64, downstream of which there are disposed sheet discharging discharge rolls 66 so that the discharged sheets are reserved in a reservoir tray 67 formed over the body housing 21. Here in FIG. 3, reference numeral 65 designates a guide chute for guiding the sheet, as delivered from the conveyor belt 80, to the fixing unit 64.

Especially in this embodiment, as shown in FIGS. 3 and 4, the conveyor belt 80 is provided with a curved portion 80*a* which is so located at a portion corresponding to the exit side tension roll 82 as to leave the sheet conveying passage 24 gradually so that the portion, as corresponding to the exit side tension roll 82 of the conveyor belt 80, of the sheet conveying passage 24 provides a sheet separating portion SP for separating the sheet 25 naturally.

Downstream of the sheet separating portion SP of the conveyor belt 80, moreover, there is arranged a sheet separation aiding device 100.

This sheet separation aiding device 100 is equipped with a discharge electrode member 110 arranged at a dischargeable position to confront the conveyor belt 80, and a bias applying unit 120 for establishing the discharge between the discharge electrode member 110 and the conveyor belt 80.

Figure 5:
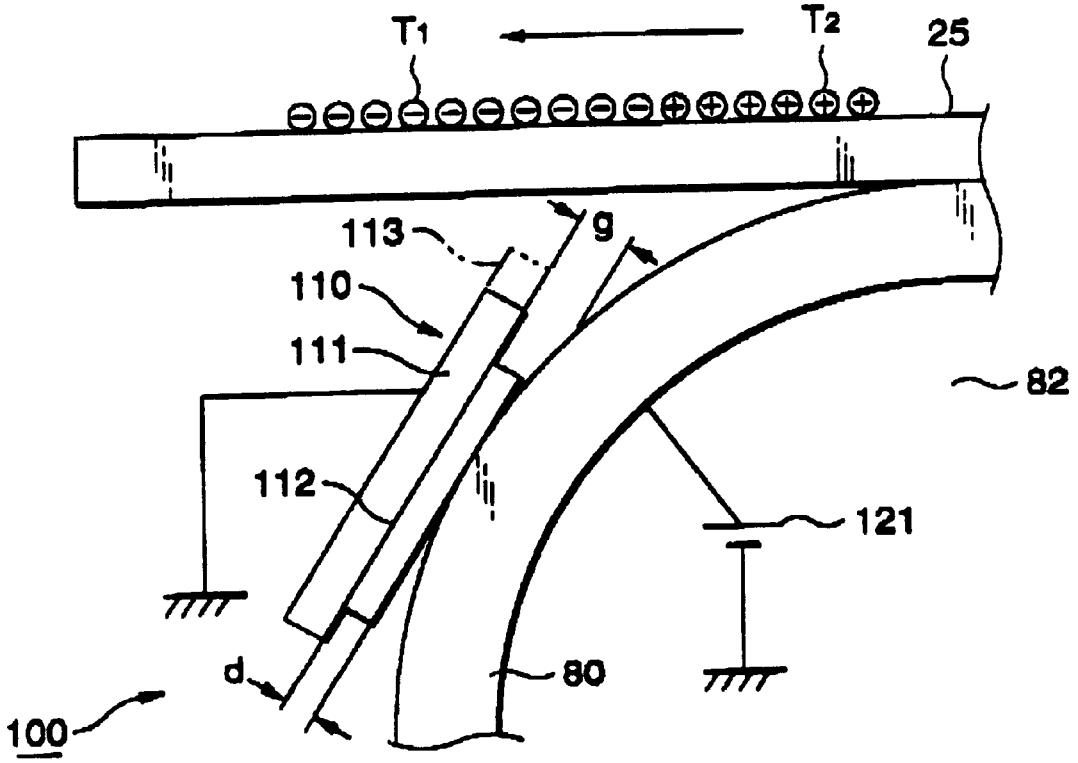
FIG. 5 is an enlarged explanatory diagram showing the detail of the sheet separation aiding device of the image forming apparatus according to Embodiment 1.

In this embodiment, the discharge electrode member 110 is composed, as shown in FIGS. 4 and 5, of an elongated conductive metal plate (or discharge electrode plate) 111 made of a SUS sheet and extending in a widthwise direction perpendicular to the moving direction of the sheet 25, and an insulating sheet member 112 acting as a spacer fixed to the metal plate 111 on the side face of the conveyor belt 80. The discharge electrode member 110 is fixedly arranged through the not-shown bracket with the insulating sheet member 112 being in contact on the conveyor belt 80.

Here, the insulating sheet member 112 is made of a polyimide film, for example, and its thickness d is so selected that a gap g between the leading edge portion of the metal plate 111 and the surface of the conveyor belt 80 may satisfy a dischargeable small gap (i.e., a gap satisfying the Paschen's law) such as about 50 to 300 microns.

In this embodiment, on the other hand, the bias applying unit 120 connects the bias power supply 121, to which a positive separation aiding bias VSB (e.g., a constant current control of +1.5 $\mu$oA in this embodiment), with the exit side tension roll 82 of the conveyor belt 80 and grounds the metal plate 111 of the discharge electrode member 110 to the ground.

In this embodiment, moreover, the metal plate 111 of the discharge electrode member 110 is arranged at its leading edge portion as close to the sheet separating portion SP as possible.

Figure 6:
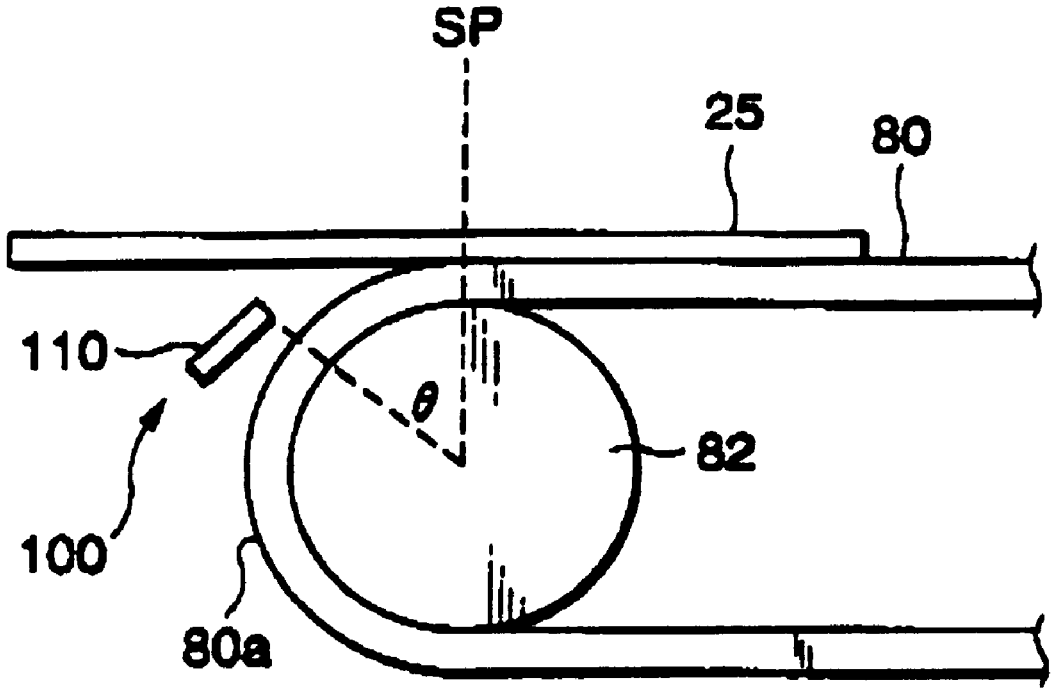
FIG. 6 is an explanatory diagram showing the layout of the sheet separation aiding device of the image forming apparatus according to Embodiment 1.

As shown in FIG. 6, more specifically, the discharge portion (i.e., the leading edge portion of the metal plate 111 in this embodiment) of the discharge electrode member 110 is set at an angle θ within 90 degrees, as taken in the rotating direction, with respect to the sheet separating portion SP of the tension roll 82.

In this case, the discharge portion of the discharge electrode member 110 is usually arranged in a wedge region to be formed between the sheet 25 separated at the sheet separating portion SP and the portion 80*a*, as running on the tension roll 82, of the conveyor belt 80.

On the other hand, the layout of the discharge electrode member 110 is preferably made as close to the sheet separating portion SP as possible but is required to retain such a gap as to establish no discharge between the metal plate 111 and the sheet 25.

When the sufficient gap cannot be retained between the metal plate 111 and the sheet 25, however, an insulating member 113 has to be disposed on the end portion of the metal plate 111 on the side of the sheet 25, as indicated by phantom lines in FIG. 5, to block the discharge between the metal plate 111 and the sheet 25.

Figure 7A:
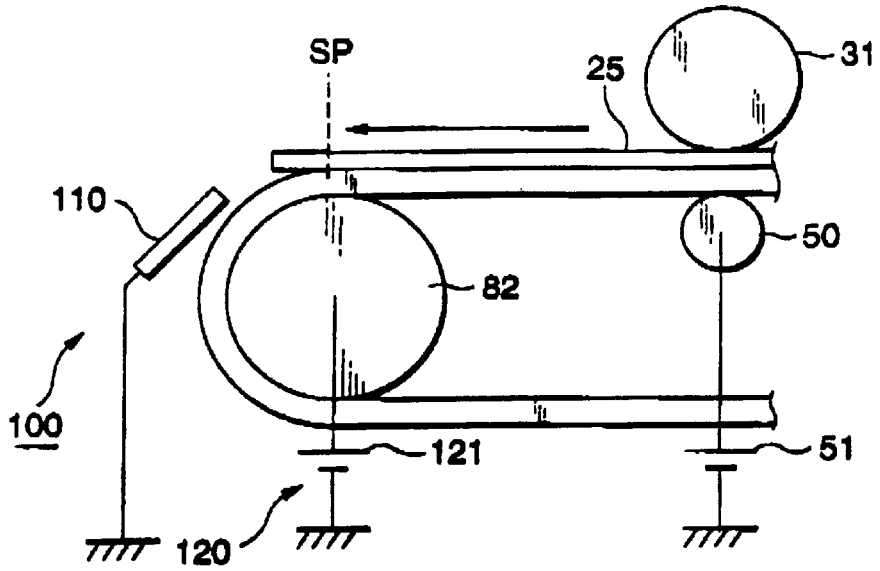
FIG. 7A is an explanatory diagram showing a relation between a sheet to pass through a sheet separating portion and the ON/OFF actions of the sheet separation aiding device.
Figure 7B:
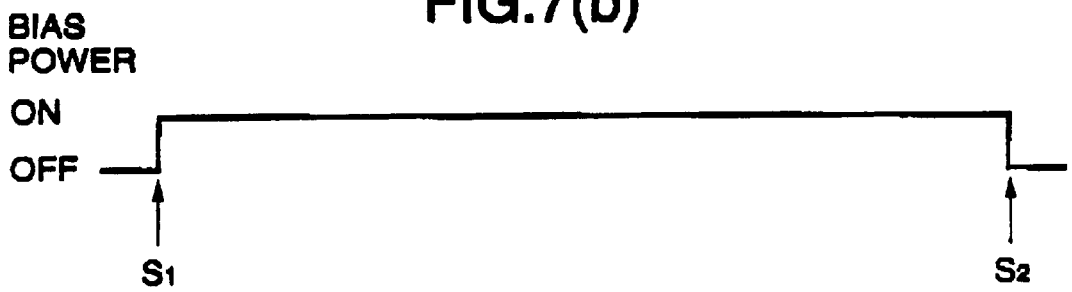
FIG. 7B is a timing chart for the relation.

In this embodiment, on the other hand, a separation aiding bias power supply 121 of the sheet separation aiding device 100 is timed ON/OFF with the absorption bias power supply 92 of the sheet adsorbing unit 90 and the transfer bias power supply 51 of the transfer rolls 50, as shown in FIGS. 7A and 7B, so that the sheet separation aiding device 100 continuously acts for the time period from the instant when the sheet 25 is adsorbed and held by the conveyor belt 80 to the instant when the sheet 25 passes over the sheet separating portion.

In this embodiment, more specifically, in the sheet conveying passage positioned upstream of the sheet adsorbing portion, there is arranged a sheet passage sensor 83 for detecting that the leading edge portion of the sheet 25 has passed. On the exit side of the sheet separating portion SP, on the other hand, there is arranged a sheet passage sensor 84 for detecting that the trailing end portion of the sheet 25 has passed. Moreover, the bias power supply 121 (as set in synchronism with the adsorption bias power supply 92 and the transfer bias power supply 51) is turned ON in synchronism with a signal S1 coming from the sheet passage sensor 83 and OFF in synchronism with a signal S2 coming from the sheet passage sensor 84, as shown in FIG. 7B.

Here in case the image forming job extends over a plurality of sheets, the signal S1 from the sheet passage sensor 83 to the first sheet 25 and the signal S2 from the sheet passage sensor 84 to the final sheet 25 are trigger signals for turning ON/OFF the individual bias power supplies 92, 51 and 121.

Here will be described the actions of the color image forming apparatus according to this embodiment.

First of all, the number of image forming sheets is designated, and the not-shown start switch is depressed. Then, the sheets 25 in the sheet feeding cassette 23 are fed out by the feed roll 61 and are nipped and conveyed by the feed rolls 62 toward the conveyor belt 80.

At this time, when the leading edge of the first sheet 25 passes through the sheet passage sensor 83, the ON actions are started at the adsorption bias power supply 92, the transfer bias power supply 51 and the separation aiding bias power supply 121.

When the sheet 25 goes in this state into the nipping region between the adsorption roll 91 and the tension roll 81 of the sheet adsorbing unit 90, the adsorption roll 91 carries the − charges sequentially to its portion confronting the tension roll 81 the − charges and the + charges are homogeneously applied to the surface of the sheet by the + charges on the side of the tension roll 81. As a result, the sheet 25 is electrostatically adsorbed by the conveyor belt 80.

The sheet 25 thus electrostatically adsorbed is conveyed by the conveyor belt 80 to pass sequentially through the transfer portions of the individual image forming units 22 (22*a* to 22*d*). Then, the toner images of the individual color components on the photosensitive drum 31 are sequentially transferred to the sheet 25 by the transferring electric field of the transfer rolls 50.

After this, the sheet 25 having passed through the individual image forming units 22 (22*a* to 22*d*) is separated at the sheet separating portion SP of the conveyor belt 80 and is then conveyed through the guide chute 65 to the fixing unit 64. The sheet 25, on which the unfixed toner image is fixed by the fixing unit 64, is discharged through the discharge rolls 66 to the reservoir tray 67.

Here in this embodiment, at the stage when the final sheet 25 of the image forming job passed through the sheet passage sensor 84, the individual bias power supplies 92, 51 and 121 are turned OFF.

Here noting the step of separating the sheet 25, it has been confirmed that no toner dispersion is found in the toner image on the sheet 25 thereby to cause no image deterioration.

This confirmation is thought to come from the following fact. The sheet separation aiding device 100 is always acting before the sheet 25 is adsorbed and held by the conveyor belt 80 and till the sheet 25 is completely separated from the conveyor belt 80. For this time period, the discharged ions, as generated by the discharge electrode member 110 and the conveyor belt 80, are always fed to the vicinity of the sheet separating portion SP so that the whole back of the sheet 25, as passing through the sheet separating portion SP, and the surface of the corresponding conveyor belt 80 are effectively destaticized.

Here will be presented the following comparison for evaluating the performances of the color image forming apparatus according to this embodiment.

Figure 8:
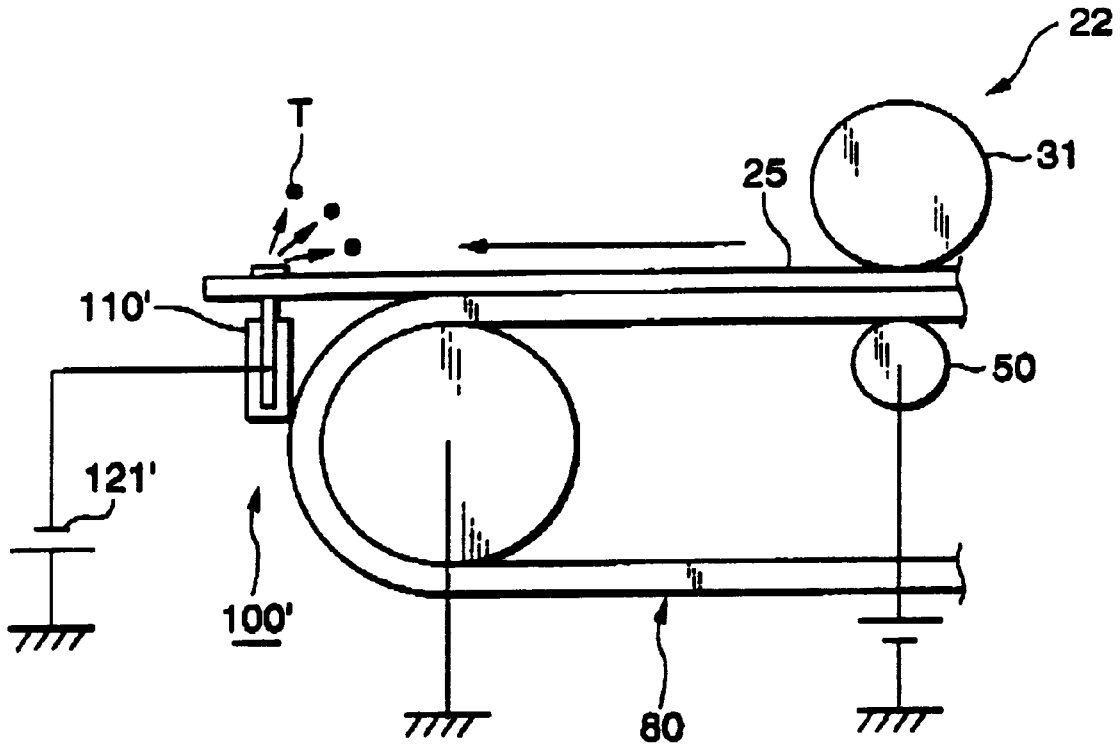
FIG. 8 is an explanatory diagram showing a sheet separation aiding device according to a comparison model.

Now, it is imagined as a sheet separation aiding device 100' according to the comparison, as shown in FIG. 8, that a sheet discharge electrode member 110' (using a saw-tooth discharge electrode member, for example) to confront the sheet 25 is arranged downstream of the sheet separating portion SP, and that a bias from a bias power supply 121' is applied to the sheet discharge electrode member 110' to establish a discharge between the sheet discharge electrode member 110' and the sheet 25 thereby to destaticize the sheet 25.

In this comparison, as shown in FIG. 8, it has been confirmed that the toner T is dispersed from the toner image on the sheet 25 by the discharge established between the sheet discharge electrode member 110' and the sheet 25, and that the image deterioration is caused by the toner dispersion.

Thus, it could be understood this embodiment is superior to the comparison.

Here, the performance evaluations of this embodiment will be described in detail in the later-described embodiment.

In this embodiment, on the other hand, the sheet separation aiding device 100 acts continuously before the sheet 25 is adsorbed and held by the conveyor belt 80 and till the sheet 25 passes over the sheet separating portion SP. From the standpoint of avoiding the toner dispersion of the toner image on the sheet 25, however, all over at least a toner image forming region (or image region) A on the sheet 25, as shown in FIG. 7C, the bias power supply 121 may be turned ON at the timing at which the discharged ions, as generated between the discharge electrode member 110 and the conveyor belt 80, are fed to the vicinity of the sheet separating portion SP.

Figure 7C:
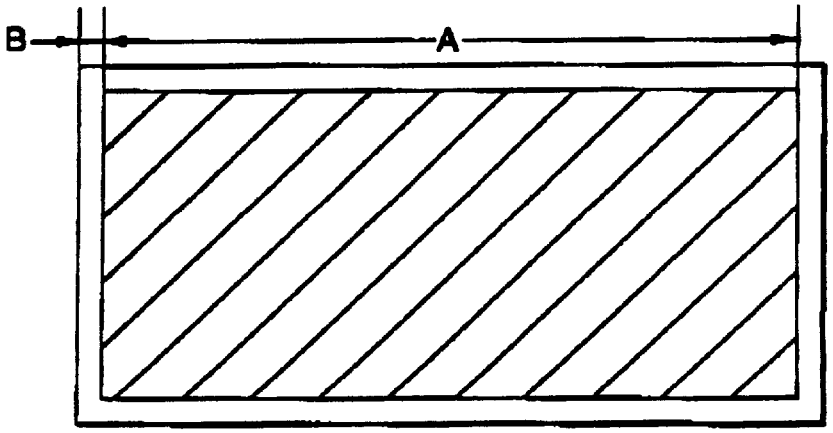
FIG. 7C is an explanatory diagram showing a necessary range for the ON action in the sheet separation aiding device.

Moreover, if the bias power supply 121 is turned ON at the timing at which the discharged ions, as generated between the discharge electrode member 110 and the conveyor belt 80, are fed to the vicinity of the sheet separating portion SP all over a leading edge region B of the sheet 25 in addition to at least the toner image forming region (or image region) A on the sheet 25, as shown in FIG. 7C, it is possible to avoid the toner dispersion of the toner image on the sheet 25. In addition, the sheet 25 can be smoothly separated by destaticizing the leading edge portion of the sheet 25 and the corresponding portion of the conveyor belt 80.

This embodiment should not be limited to the mode thus far described but may be suitably modified in the following manners.

Figure 9:
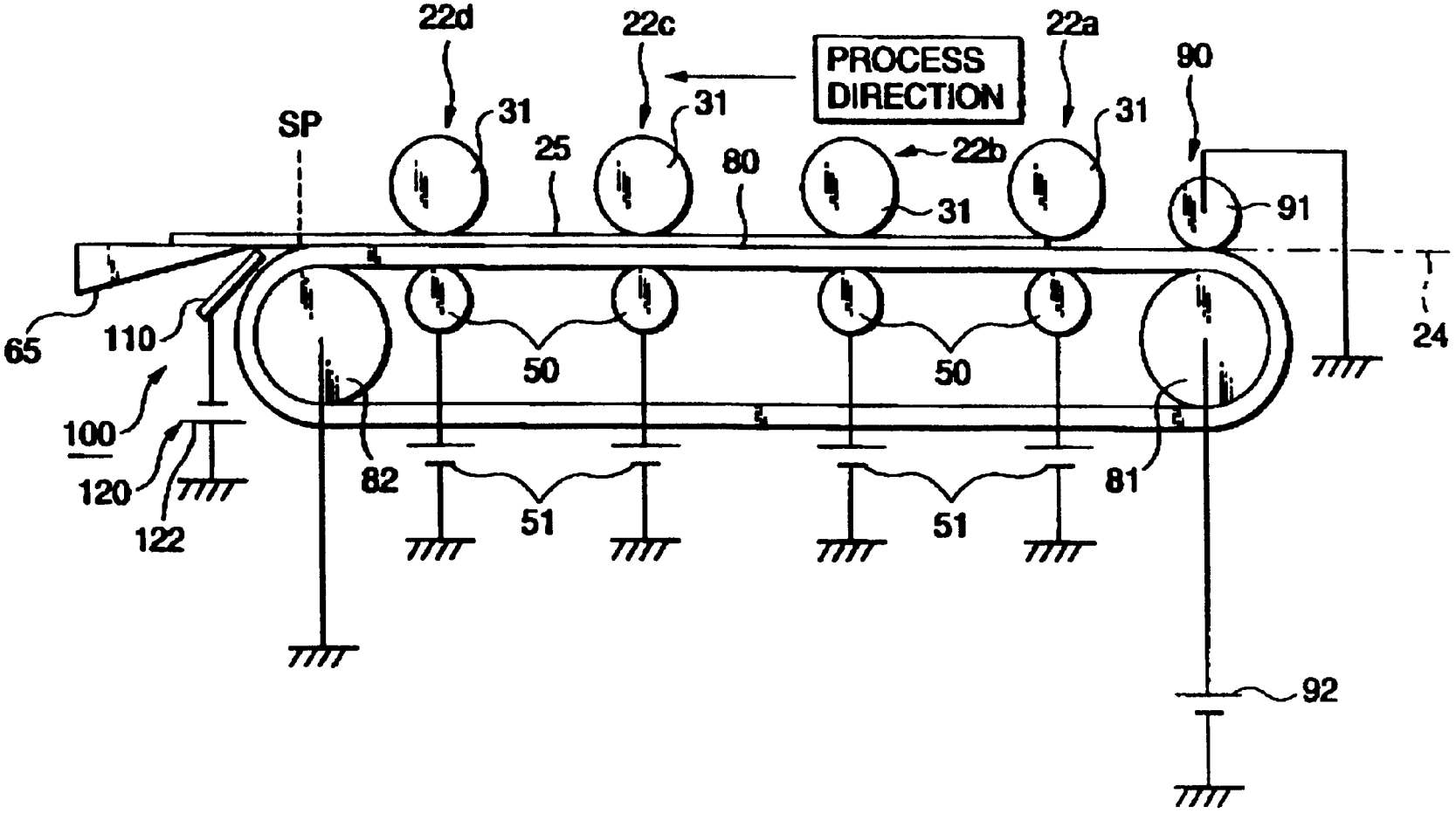
FIG. 9 is an explanatory diagram showing another example of a bias applying method of Embodiment 1.

In this embodiment, for example, the bias applying unit 120 is embodied by connecting the bias power supply 121 of the positive polarity (as reversed from the toner polarity) with the tension roll 82 and by grounding the discharge electrode member 110 to the earth. As shown in FIG. 9, for example, the mode may be modified by connecting a bias power supply 122, to which the separation aiding bias VSB of the negative polarity (the same as the toner polarity) is applied, with the discharge electrode member 110 and by grounding the tension roll 82 to the earth.

Figure 10:
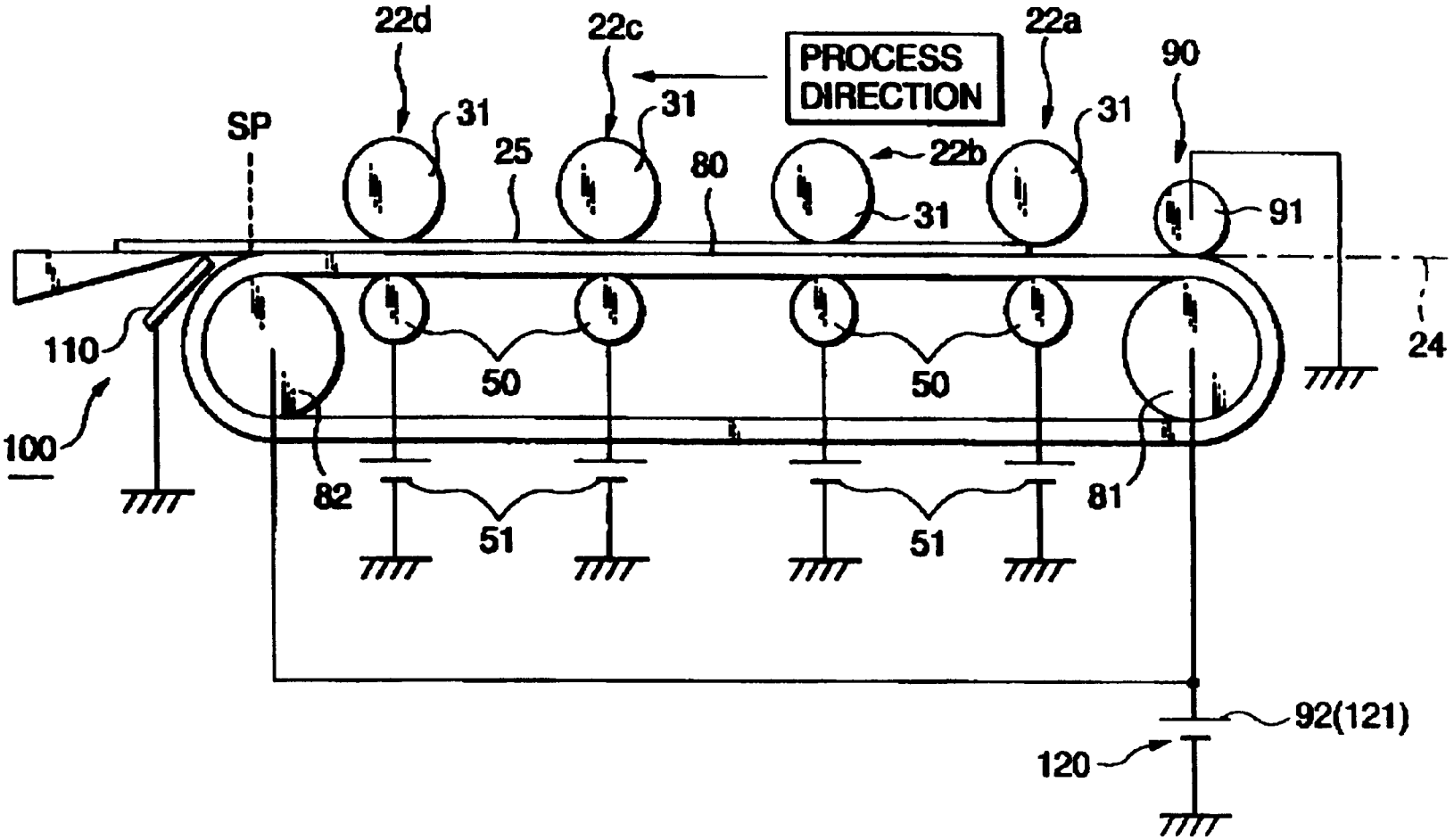
FIG. 10 is an explanatory diagram showing still another example of the bias applying method of Embodiment 1.

In this embodiment, moreover, the bias applying unit 120 is provided separately and independently. From the standpoint of simplifying the apparatus construction, however, the adsorption bias power supply 92 may also be used as the bias power supply 121, as shown in FIG. 10.

In this mode, the sheet adsorbing unit 90 and the sheet separation aiding device 100 are activated by the common bias power supply 92 (121). Since the adsorbing action of the sheet 25 by the sheet adsorbing unit 90 and the separation aiding action of the sheet 25 by the sheet separation aiding device 100 are ordinarily performed at the substantially different timings, however, neither is caused the voltage fluctuation of the bias power supply 92 (121) by the sheet adsorbing unit 90 at the separation aiding action of the sheet 25 by the sheet separation aiding device 100, nor is caused the voltage fluctuation of the bias power supply 92 (121) by the sheet separation aiding device 100 at the adsorbing action of the sheet 25 by the sheet adsorbing unit 90.

Even if the bias power supply 92 (121) should be shared, therefore, the individual actions of the sheet adsorbing unit 90 and the sheet separation aiding device 100 are stably performed.

In this embodiment, on the other hand, the discharge electrode member 110 is composed of the metal plate 111 and the insulating sheet member 112. However, the discharge electrode member 110 should not be limited thereto but may be suitably modified in the following manner if it can effect a discharge between itself and the conveyor belt 80.

The discharge electrode member 110 may be modified by mounting only the metal plate 111 on the not-shown bracket without providing any insulating member such as the insulating sheet member 112.

Figure 11A:
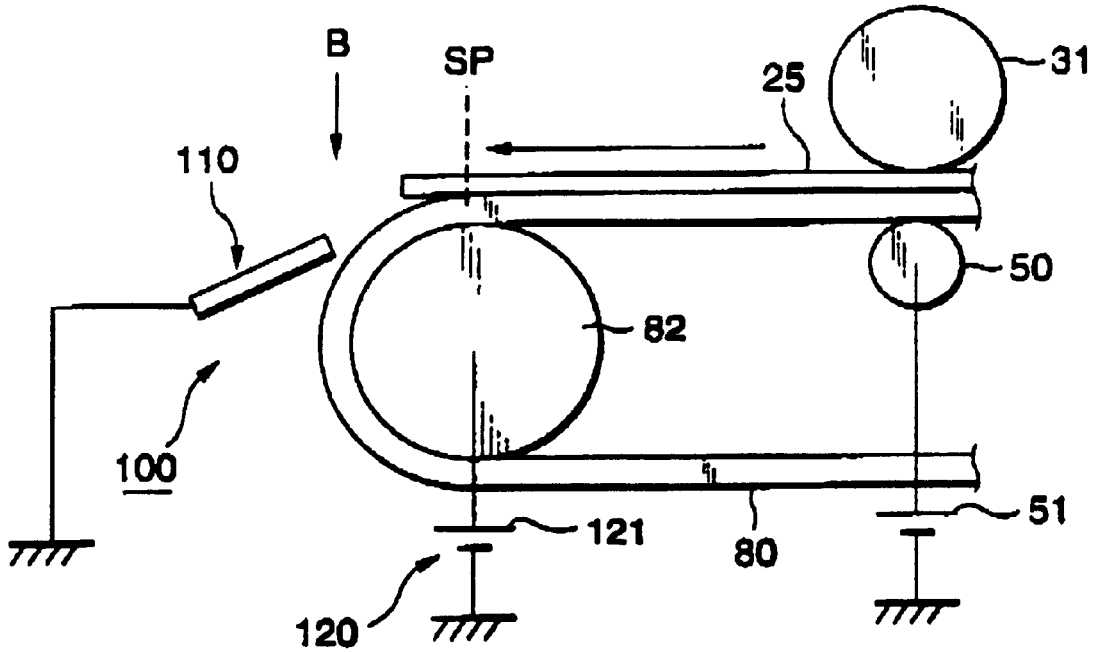
FIG. 11A is an explanatory diagram showing another example of a discharge electrode member.
Figure 11B:
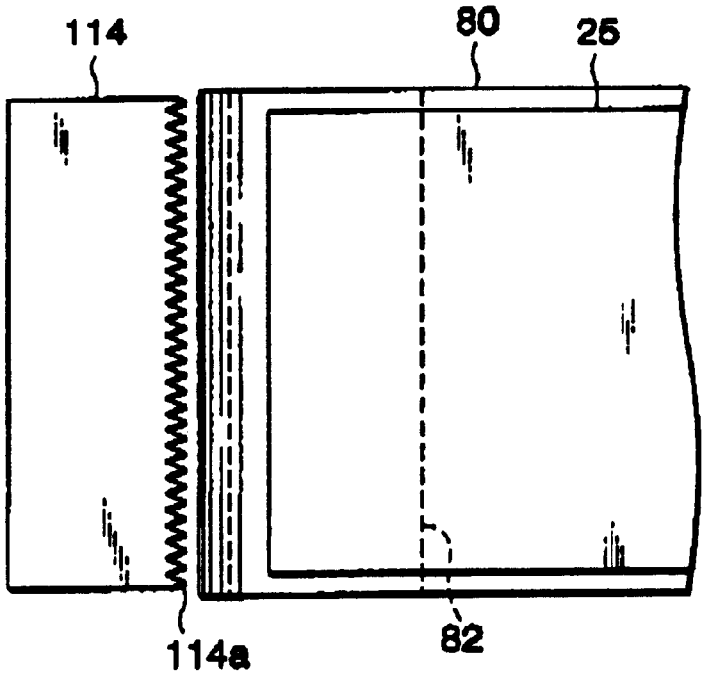
FIG. 11B is a view taken in direction of arrow B from FIG. 11A.

Alternatively, the mode may be modified such that a number of saw-tooth projections 114*a* are formed on the portion, as opposed to the conveyor belt 80, of a metal plate 114, as shown in FIGS. 11A and 11B, to concentrate the discharging electric field at the edges of the individual saw-tooth projections 114*a*.

Figure 12A:
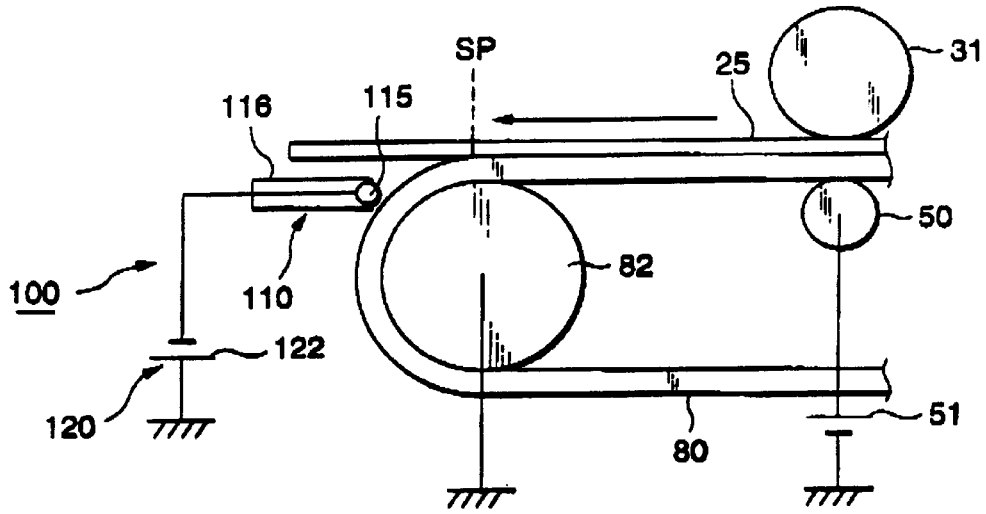
FIGS. 12A and 12B are explanatory diagrams showing still another example of the discharge electrode member.

As shown in FIG. 12A, alternatively, a discharge wire 115 of about 100 microns, for example, may be extended along the widthwise direction of the conveyor belt 80 between two end supports 116 to establish the discharge between the discharge wire 115 and the conveyor belt 80.

Figure 12B:
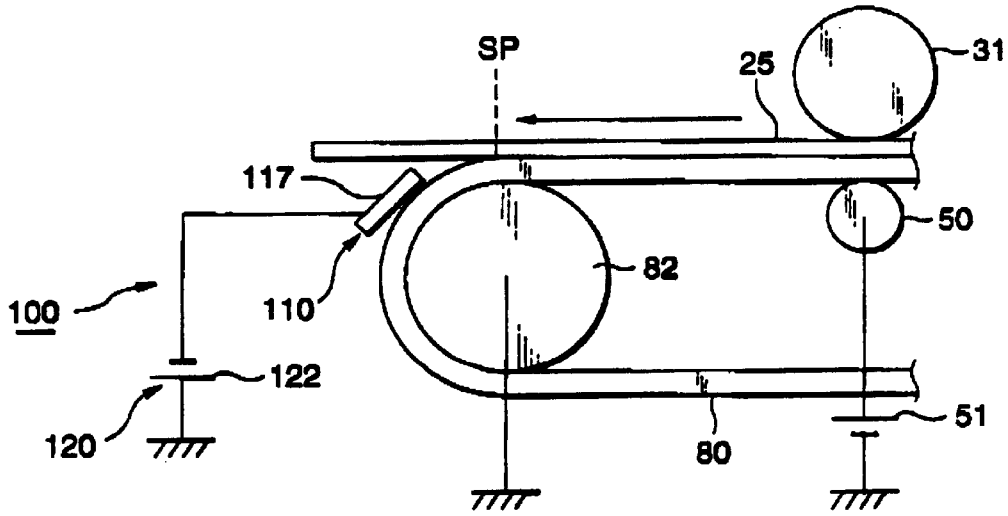

As shown in FIG. 12B, alternatively, a dielectric film 117 having a thickness of about 100 microns, for example, may be extended along the widthwise direction of the conveyor belt 80 to establish the discharge between the dielectric film 117 and the conveyor belt 80.

Figure 13:
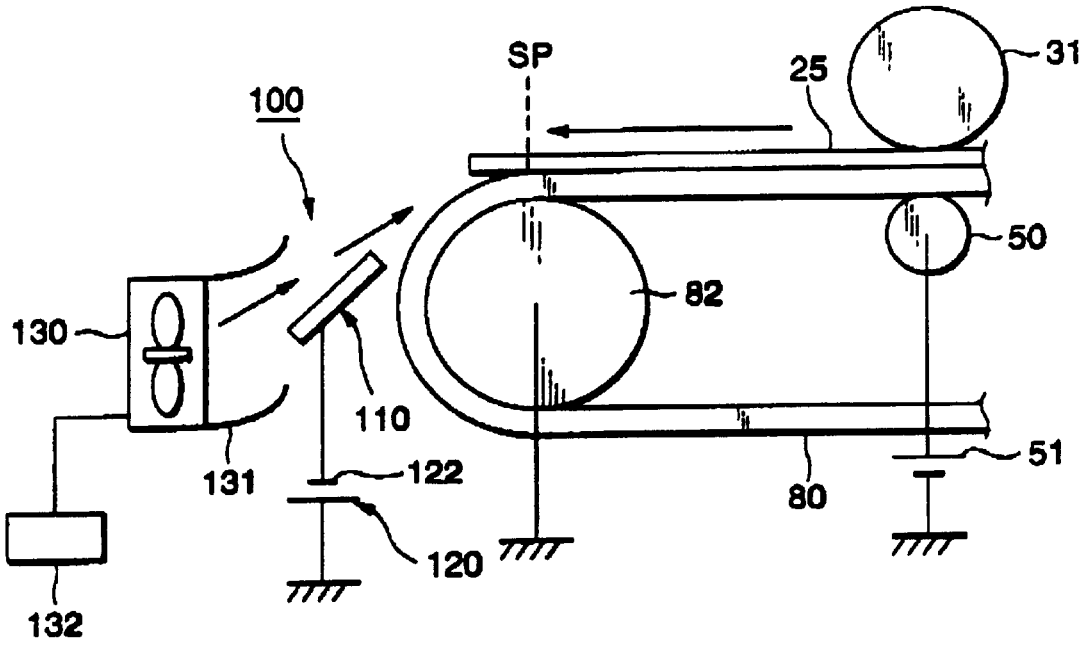
FIG. 13 is an explanatory diagram showing an example for coping with the case in which the discharge electrode member of Embodiment 1 is spaced from the sheet separating portion.

In this embodiment, moreover, the discharge electrode member 110 is arranged close to the sheet separating portion SP so that the discharged ions, as generated between the discharge electrode member 110 and the conveyor belt 80, are effectively fed to the vicinity of the sheet separating portion SP. For the convenience of the layout, however, under the situation in which the discharge electrode member 110 is arranged at a spacing from the sheet separating portion SP, a fan 130 is preferably disposed in the vicinity of the discharge electrode member 110, as shown in FIG. 13, and a guide cylinder 131 or the like is preferably added to the fan 130, so that the discharged ions, as generated from the discharge electrode member 110, may be forcibly blown to the vicinity of the sheet separating portion SP to retain the feedability of the discharged ions to the vicinity of the sheet separating portion SP. Here, reference numeral 132 appearing in FIG. 13 designates a power supply for driving the fan 130.

Figure 14:
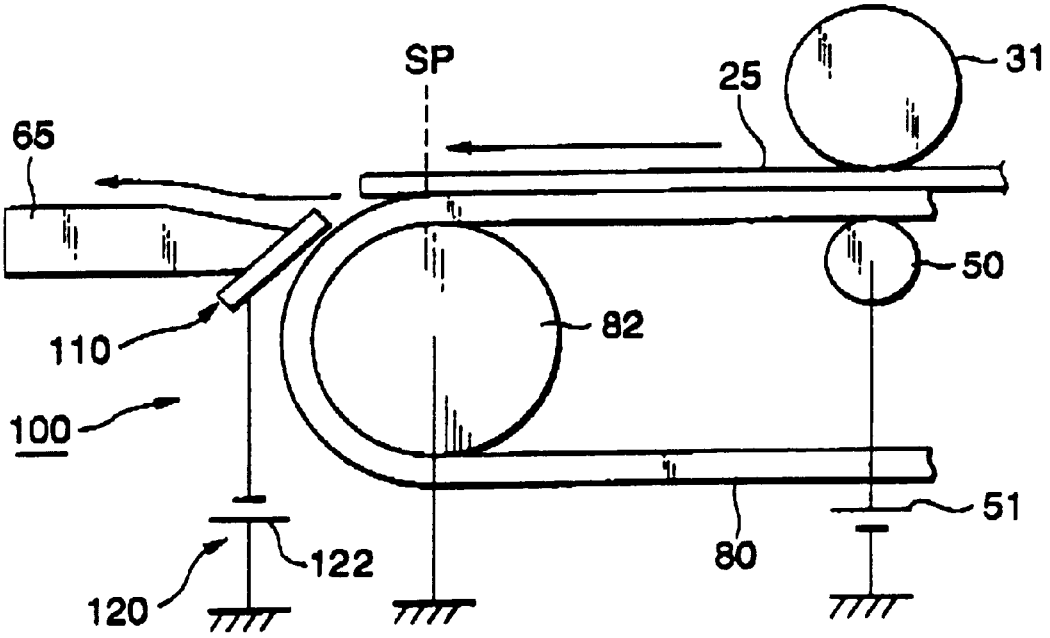
FIG. 14 is an explanatory diagram showing an example in which the discharge electrode member of Embodiment 1 and a guide member are integrated.

In this embodiment, still moreover, the sheet separation aiding device 100 and the guide chute 65 are provided independently of each other. As shown in FIG. 14, however, the discharge electrode member 110 may be integrated with the guide chute 65 on the side of the conveyor belt 80.

In this mode, however, the guide chute 65 may be made of an arbitrarily selected material. Since the sheet 25 is arranged in contact with the guide chute 65, however, consideration has to be taken to establish no discharge between the sheet 25 and the discharge electrode member 110 when the sheet 25 is guided by the guide chute 65.

[Embodiment 2]

Figure 15:
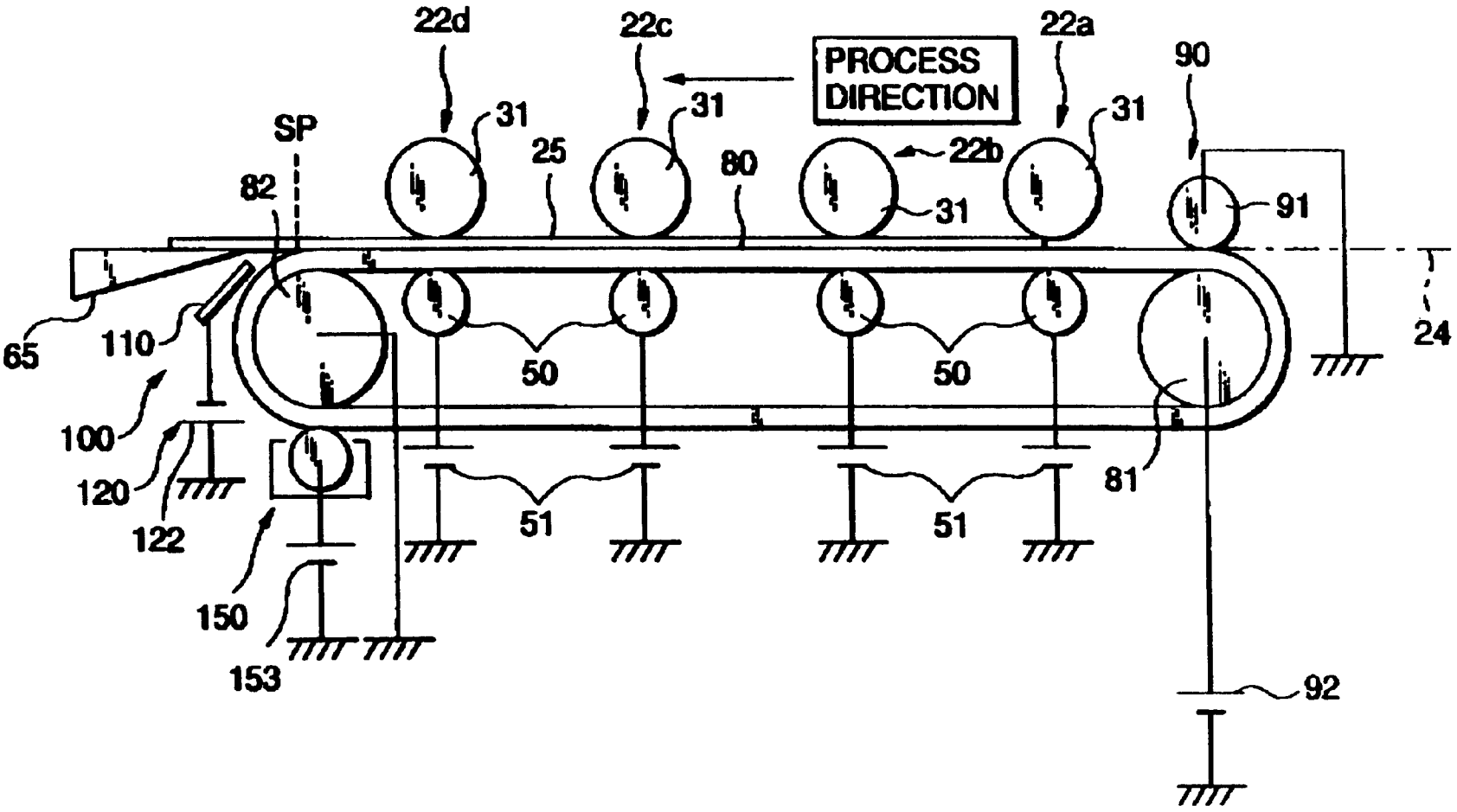
FIG. 15 is an explanatory diagram showing an essential portion of an image forming apparatus according to Embodiment 2.

FIG. 15 is an explanatory diagram showing Embodiment 2 of the image forming apparatus to which the invention is applied.

In FIG. 15, the fundamental construction of the color image forming apparatus according to this embodiment is substantially similar to that of Embodiment 1. In addition to Embodiment 1, however, a belt cleaner 150 is disposed at the conveyor belt 80 on the downstream side of the sheet separating portion SP. Here, components similar to those of Embodiment 1 are designated by the numerals similar to those of Embodiment 1, and their detailed descriptions will be omitted.

Figure 16:
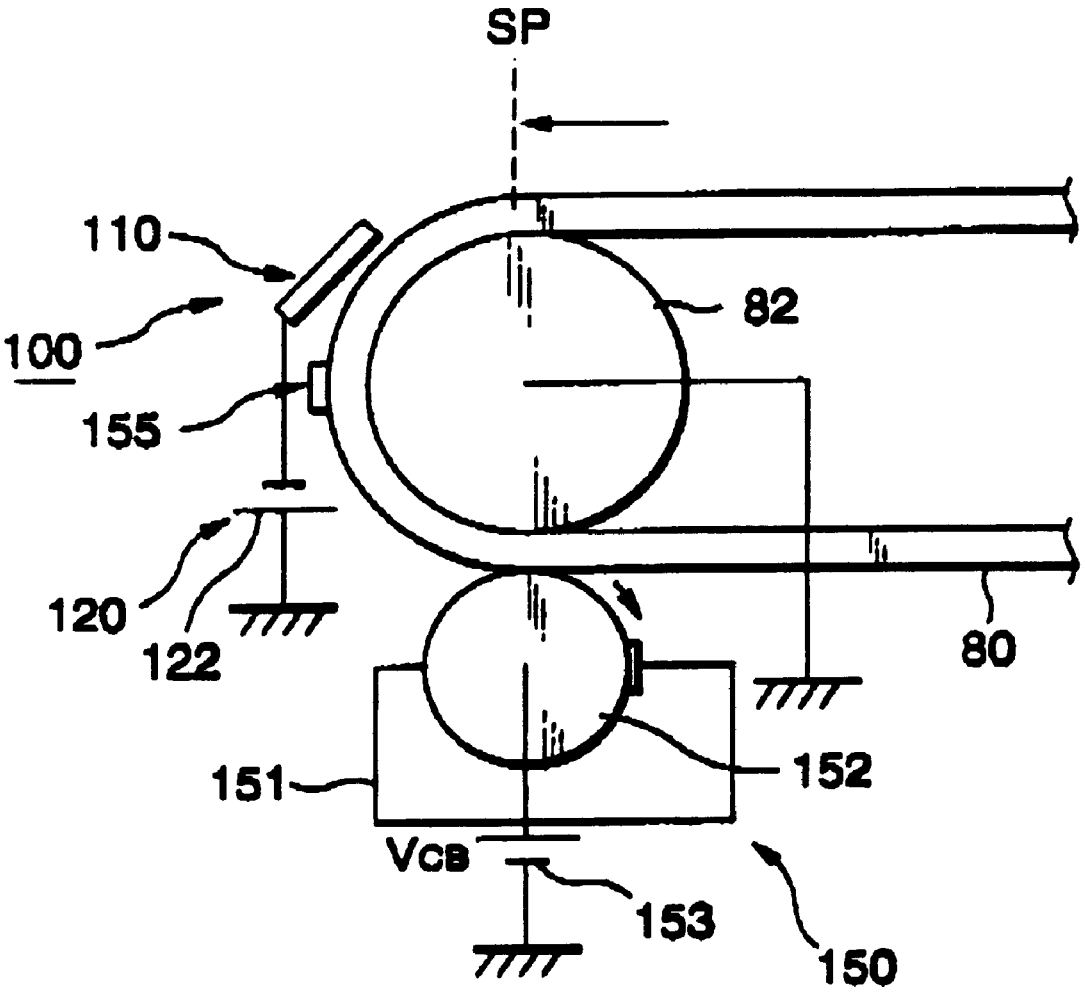
FIG. 16 is an explanatory diagram showing the detail of the neighborhood of a belt cleaner of the image forming apparatus according to Embodiment 2.

In this embodiment, the belt cleaner 150 is equipped, as shown especially in FIG. 16, with a cleaner housing 151 which is opened to confront the portion, as located downstream of the discharge electrode member 110, of the tension roll 82 of the conveyor belt 80. In this cleaner housing 151, there is disposed a cleaning roll 152 which is arranged in contact with or in the vicinity of the conveyor belt 80. With this cleaning roll 152, there is connected a cleaning bias power supply 153 to which a cleaning bias VCB (at the positive polarity in this embodiment, as reversed from the tone r polarity) is applied.

In this embodiment, moreover, the belt cleaner 150 turns ON the aforementioned cleaning bias power supply 153 under the condition in which the toner resides on and sticks to th e conveyor belt 80, by detecting the density after a density detecting patch was transferred to the conveyor belt 80, for example, The sheet separation aiding device 100 is made coactive with the belt cleaner 150 in the operations other than the sheet separation.

In the color image forming apparatus according to this embodiment, therefore, under the situation in which the residual toner 155 sticks to the conveyor belt 80, the sheet separation aiding device 100 acts to establish the discharge between the discharge electrode member 110 and the conveyor belt 80.

By the discharge, the residual toner 155 on the conveyor belt 80 is increased at its charge (or tribo-value) so that the increased residual toner 155 reaches the portion of the belt cleaner 150.

Since, at this time, the cleaning bias VCB at the polarity reversed from the toner polarity is applied to the cleaning roll 152, the increased residual toner 155 is subjected to an intense electrostatic attraction to shift it to toward the cleaning roll 152 so that the residual toner 155 on the conveyor belt 80 is easily carried toward the cleaning roll 152 and cleaned out.

Here, the cleaning roll 152 may preferably be exemplified to have a brush shape, and there may be provided a separate unit for cleaning the cleaning roll 152.

[Embodiment 3]

Figure 17:
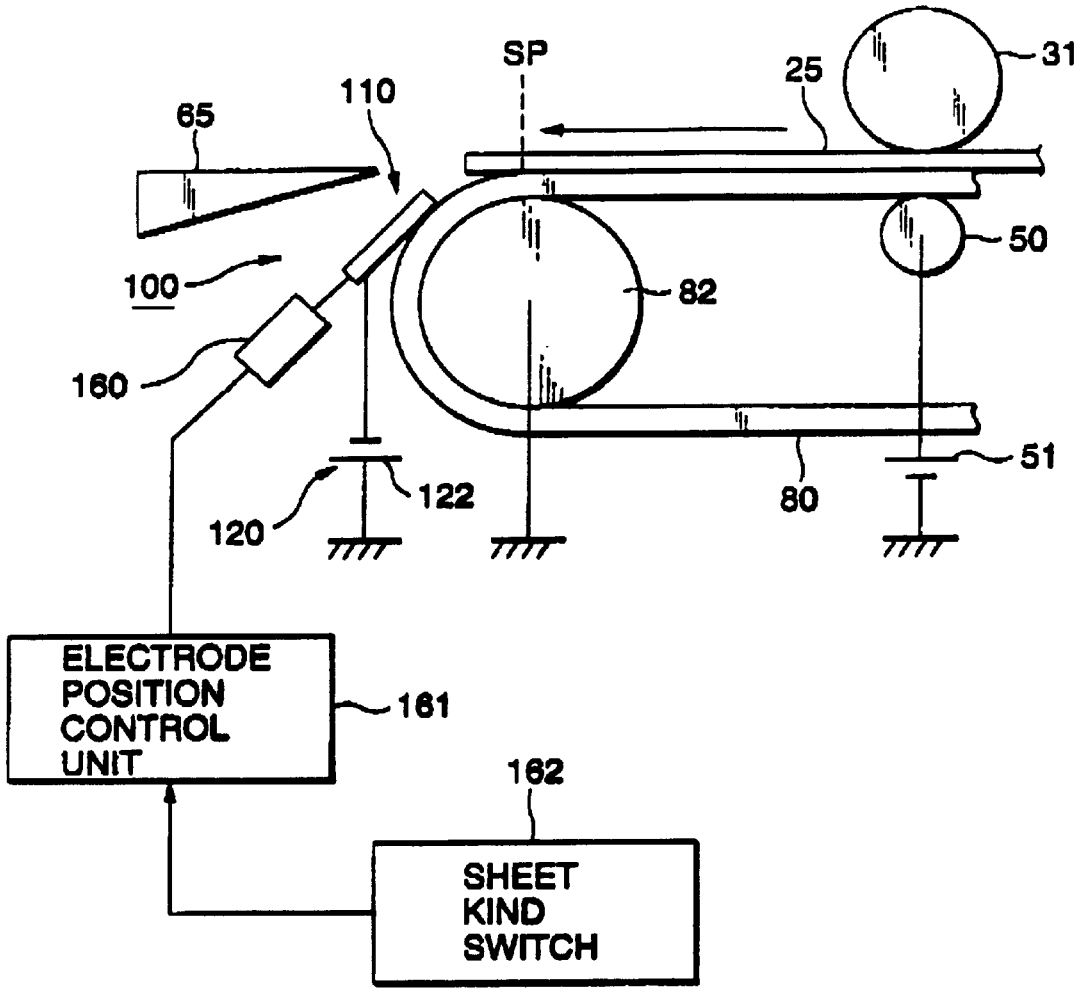
FIG. 17 is an explanatory diagram showing an essential portion of an image forming apparatus according to Embodiment 3.

FIG. 17 shows an essential portion of Embodiment 3 of the color image forming apparatus according to the invention.

In FIG. 17, the fundamental construction of the color image forming apparatus is substantially similar to that of Embodiment 1. The sheet separation aiding device 100 is basically constructed to include: the discharge electrode member 110; and the bias applying unit 120 (as exemplified in this embodiment by connecting the bias power supply 121, to which the bias at the same polarity as the toner polarity is applied, with the side of the discharge electrode member 110 and by grounding the tension roll 82 to the earth) for causing the discharge between the discharge electrode member 110 and the conveyor belt 80.

However, the discharge electrode member 110 according to this embodiment is so supported by a shift actuator 160, for example, as to move back and forth, and this shift actuator 160 moves the discharge electrode member 110 back and forth in response to a control signal coming from an electrode position controller 161 (as composed of a microcomputer, for example).

In this embodiment, the electrode position controller 161 is activated according to a select signal coming from a sheet kind switch 162 for designating the kind of the sheet 25 selectively, e.g., for selecting whether the sheet 25 is standard or thin, to send out an advanced position control signal, if the sheet 25 is standard, to advance the shift actuator 160, and to send out a retracted position control signal, if the sheet 25 is thin, to activate the shift actuator 160 to retract.

Here will be described the actions of the sheet separation aiding device 100 according to this embodiment.

Figure 18A:
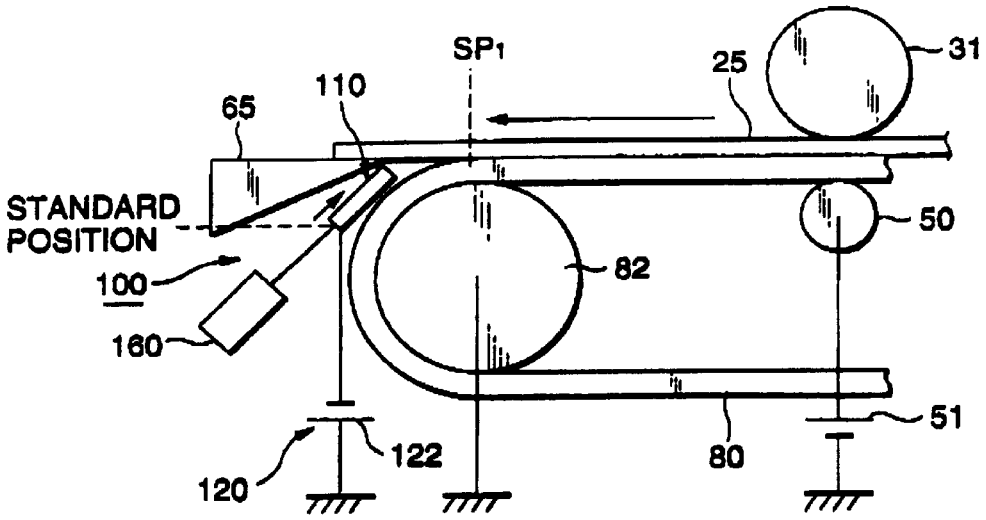
FIG. 18A is an explanatory diagram showing an action example when a sheet of low rigid such as a thin paper sheet is used.

Now, if it is assumed that the sheet 25 is standard, the electrode position controller 161 sends out the advanced position control signal, as shown in FIG. 18A, to advance the shift actuator 160.

At this time, the discharge electrode member 110 is set at the standard position so that the discharged ions, as generated between the discharge electrode member 110 and the conveyor belt 80, are reliably fed to the vicinity of a sheet separating portion SP1 of the standard sheet 25.

Figure 18B:
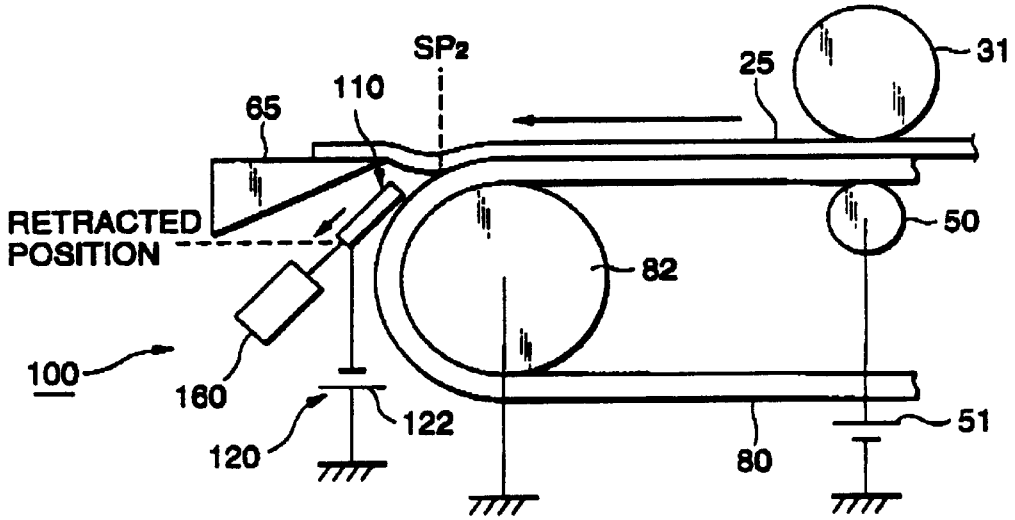
FIG. 18B is an explanatory diagram showing an action example when a sheet of high rigid such as a thick paper sheet is used.

If it is assumed that the sheet 25 is thin, on the other hand, the electrostatic adsorption of the sheet 25 for the conveyor belt 80 is strong, as shown in FIG. 18B, so that a sheet separating portion SP2 is shifted more downstream of the conveyor belt 80 than the sheet separating portion SPI of the case of the standard sheet 25.

In this embodiment, therefore, the electrode position controller 161 sends out the retracted position control signal to retract the shift actuator 160, as shown in FIG. 18B.

At this time, the discharge electrode member 110 is set at the retracted position. If the stroke of retraction of the shift actuator 160 is suitably adjusted in advance, the positional relation between the discharge electrode member 110 and the sheet separating portion SP2 is set substantially similar to that of the case of the standard sheet 25 so that the discharged ions, as generated between the discharge electrode member 110 and the conveyor belt 80, are reliably fed to the vicinity of the sheet separating portion SP2 of the thin sheet 25.

Thus in this embodiment, as the kind and the separate position of the sheet 25 are changed, the discharge electrode member 110 of the sheet separation aiding device 100 moves to an effective position, at which the sheet separating action (to generate and feed the discharged ions) can be stabilized without being influenced by the kind of the sheet 25.

Here in this embodiment, there is presented a mode in which the position of the discharge electrode member 110 is subjected to the binary control, but the invention should not be limited to the mode. Even in the case of three or more kinds of sheet 25, for the control line of the electrode position controller 161, the optimum position of the discharge electrode member 110 is stored in advance according to the sheet kind so that the discharge electrode member 110 may be moved to a desired position according to the kind of the sheet 25.

Here in this embodiment, the discharge electrode member 110 is arranged to correspond to the curved portion 80*a* of the conveyor belt 80, and the positional relation between the discharge electrode member 110 and the conveyor belt 80 may be changed according to the forward and backward movements of the discharge electrode member 110.

If the positional relation between the discharge electrode member 110 and the conveyor belt 80 is then changed, the discharging ability inbetween will change. In this embodiment, therefore, it is preferred to adopt a method in which the positional relation between the discharge electrode member 110 and the conveyor belt 80 is kept constant.

There is exemplified by a mode in which the shift actuator 160 itself is rocked in association with its forward and backward movements to keep the positional relation between the discharge electrode member 110 and the conveyor belt 80.

Figure 19:
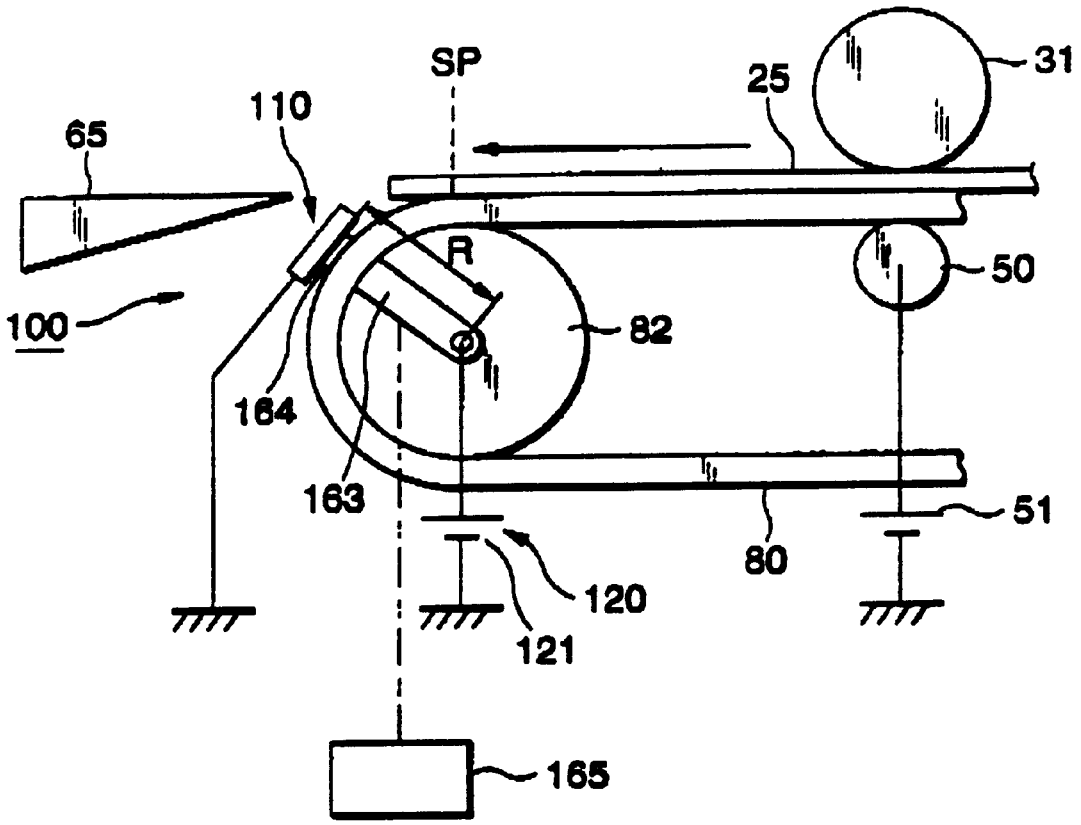
FIG. 19 is an explanatory diagram showing one example of a method of controlling a moving position in a movable type discharge electrode member used in Embodiment 3.

In another mode of method, as shown in FIG. 19, a rocking arm 163 is rotatably attached coaxially with the tension roll 82 and can be set at an arbitrary rotational position by a position actuator 165. To the leading edge of the rocking arm 163, there is attached the discharge electrode member 110 to which an insulating sheet member 164 acting as a tracking member is added. The positional relation between the discharge electrode member 110 and the conveyor belt 80 is kept by arranging the discharge electrode member 110 biased on the face of the conveyor belt 80 by the not-shown spring and by moving the discharge electrode member 110 rotationally to an arbitrary position while keeping a distance R (between the center position of the rocking arm 163 and the discharge electrode member 110).

[Embodiment 4]

Figure 20:
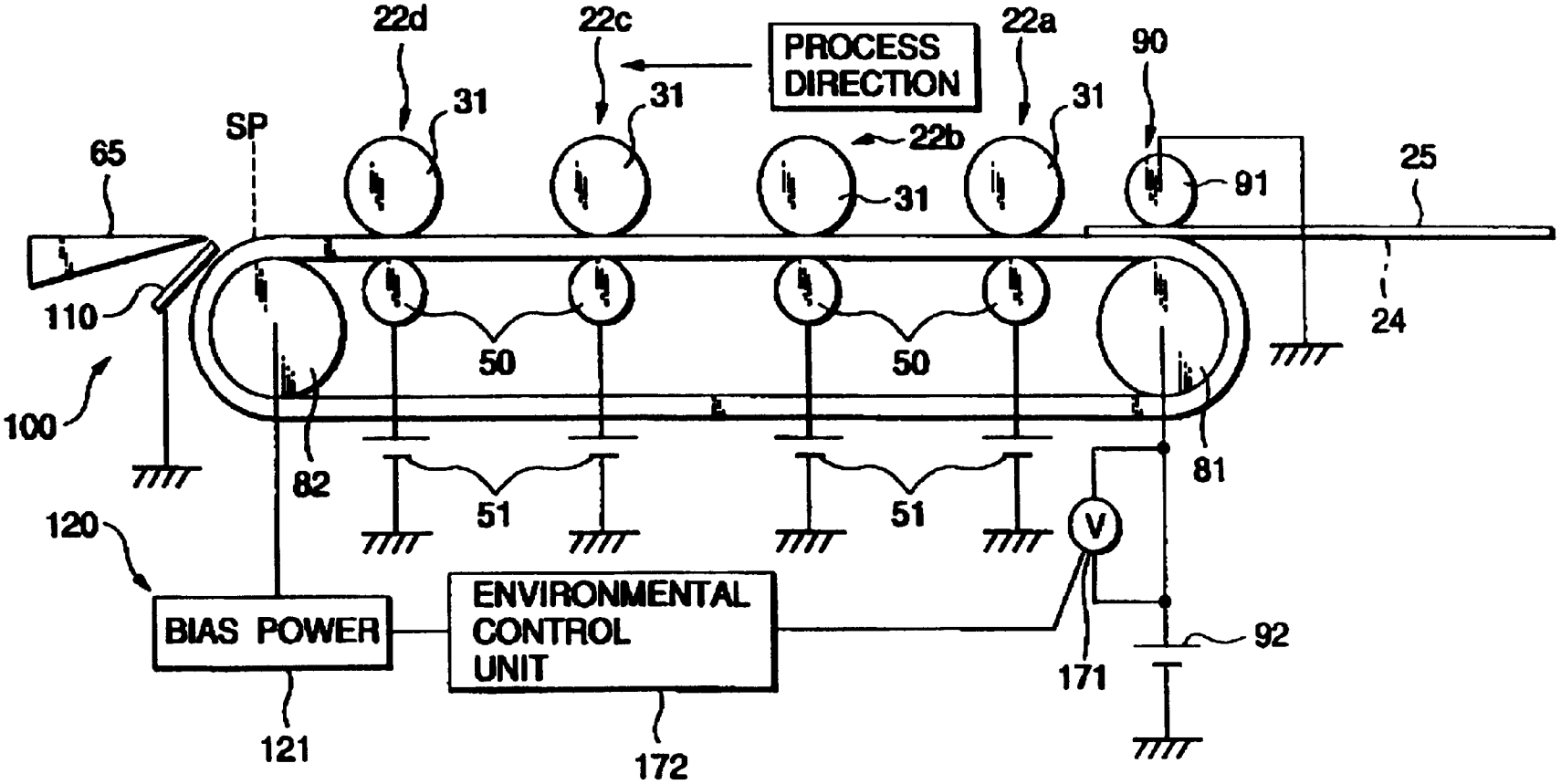
FIG. 20 is an explanatory diagram showing an essential portion of an image forming apparatus according to Embodiment 4.

FIG. 20 shows an essential portion of Embodiment 4 of the color image forming apparatus according to the invention.

In FIG. 20, the color image forming apparatus according to this embodiment is substantially similar to that of Embodiment 1 but is provided with a control line of the sheet separation aiding device 100, as different from that of Embodiment 1.

In this embodiment, more specifically, the control line of the sheet separation aiding device 100 is equipped with a voltage detector 171 for detecting an applied voltage at the action of the sheet adsorbing unit 90 (adopting a constant current control, for example, in this embodiment) to adsorb the sheet 25. In an environment controller (composed of a microcomputer in this embodiment) 172, an environmental prediction is performed on the basis of a detected voltage coming from the voltage detector 171, as fed back, to turn ON the bias power supply 121 only in the environment where the separating discharge of the sheet 25 is liable to occur, or in the low moisture environment where the resistance of the sheet 25 rises, thereby to activate the sheet separation aiding device 100.

Here will be described the actions of the sheet separation aiding device according to this embodiment.

Now, let it be assumed that the color image forming apparatus is activated in the low moisture environment. When the sheet 25 is adsorbed and held by the sheet adsorbing unit 90, the voltage to be detected by the voltage detector 171 changes to a level corresponding to the low moisture environment so that the environment controller 172 predicts the low moisture environment on the basis of the detected voltage coming from the voltage detector 171, to turn ON the bias power supply 121.

In this state, the sheet separation aiding device 100 acts to suppress the separation discharge at the separated time of the sheet 25.

Not in the case of the low moisture environment, on the other hand, the environment controller 172 predicts that the environment is not in the low moisture, on the basis of the detected voltage coming from the voltage detector 171 to keep the bias power supply 121 in the OFF state.

Not in the low moisture circumstance, therefore, the sheet separation aiding device 100 does not act so that the sheet 25 is naturally separated at the sheet separating portion SP.

Thus in this embodiment, the sheet separation aiding device 100 for suppressing the separation discharge is caused to act only in the environment where the separation discharge is liable to occur at the sheet separation time. It is therefore preferable that the power consumption can be reduced and that the electric deterioration of the conveyor belt 80 can be suppressed to the necessary minimum.

Here in this embodiment, the voltage change of the sheet adsorbing unit 90 is detected, but the invention should not be limited thereto. The voltage of the transfer rolls 50 may be detected and fed back. When the sheet adsorbing unit 90 or the transfer rolls 50 are controlled at a constant voltage, on the other hand, their individual currents may be detected and fed back. On the other hand, the resistance change of the conveyor belt 80 may be monitored and fed back.

[Embodiment 5]

Figure 21:
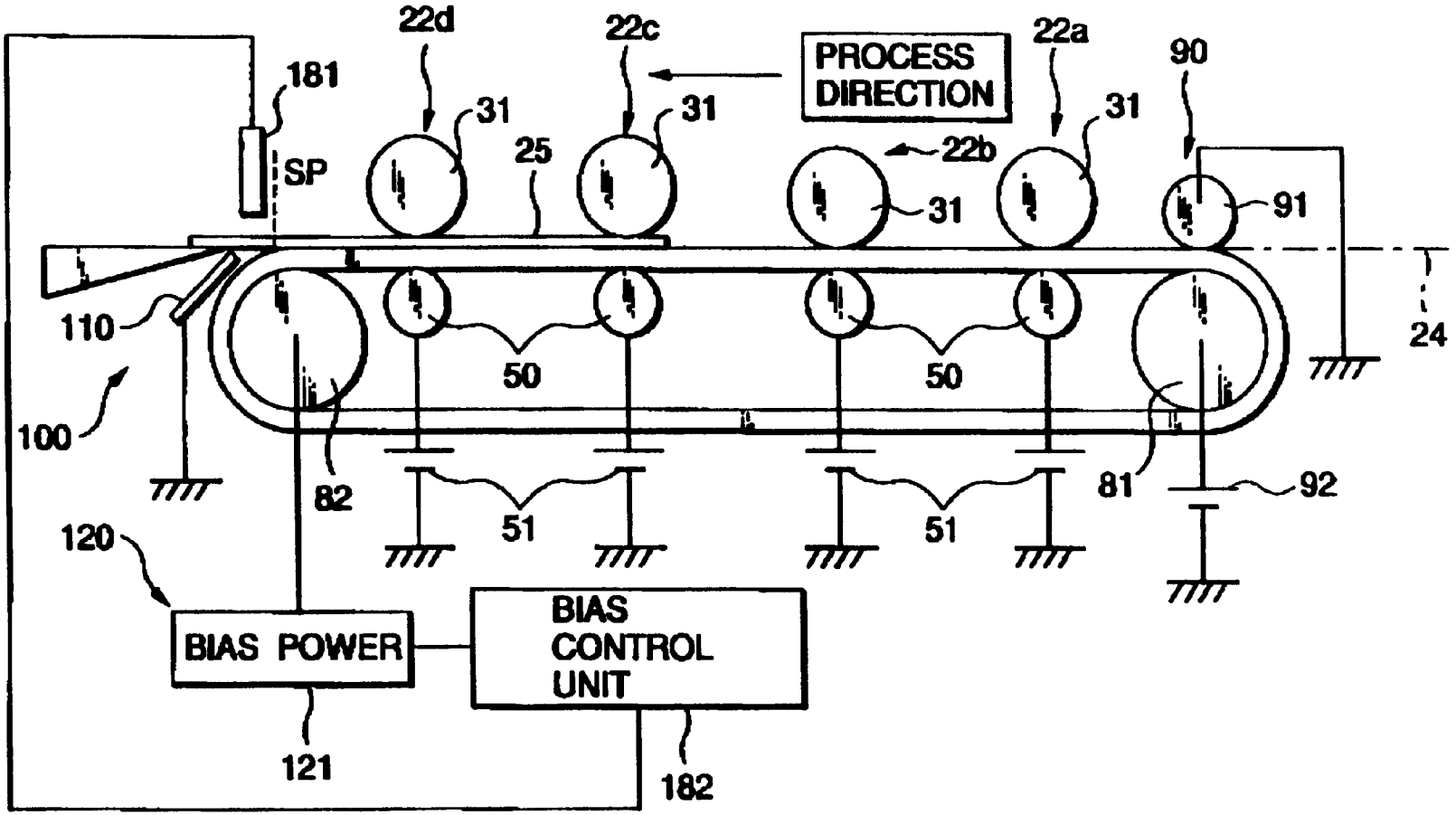
FIG. 21 is an explanatory diagram showing an essential portion of an image forming apparatus according to Embodiment 5.

FIG. 21 shows an essential portion of Embodiment 5 of the color image forming apparatus according to the invention.

In FIG. 21, the color image forming apparatus according to this embodiment is substantially similar to that of Embodiment 1 but is equipped with a control line of the sheet separation aiding device 100 different from that of Embodiment 1.

In this embodiment, more specifically, the control line of the sheet separation aiding device 100 is provided with a displacement sensor 181 which is arranged in the vicinity of the sheet separating portion SP for detecting the separation position of the sheet 25. In a bias controller (composed of a microcomputer in this embodiment) 182, the bias value of the bias power supply 121 is set variable on the basis of the detection signal coming from the displacement sensor 181.

For setting the bias value according to this embodiment, the separation position of the sheet 25 is dependent upon the positional relation between the sheet separating portion SP and the discharge electrode member 110. Thus, there is adopted a method in which the bias value of the bias power supply 121 is suitably lowered under the condition that the distance between the sheet separating portion SP and the discharge electrode member 110 is reduced.

Here will be described the actions of the sheet separation aiding device according to this embodiment.

Now, it is assumed that the sheet 25 is standard. On the basis of the detection signal coming from the displacement sensor 181, the bias controller 182 sets the bias value of the bias power supply 121 to a standard bias to turn ON the bias power supply 121 in this state.

At this time, the discharged ions, as generated between the discharge electrode member 110 and the conveyor belt 80, is at the standard level so that they are reliably fed to the vicinity of the sheet separating portion SP at the standard position.

If it is assumed that the sheet 25 is thin, on the other hand, the electrostatic adsorbing force of the sheet 25 to adsorb the conveyor belt 80 is so strong that the sheet separating portion SP deviates more downstream of the conveyor belt 80 than that of the case of the standard sheet 25. This positional change of the sheet 25 is detected by the displacement sensor 181.

Then, on the basis of the detection signal coming from the displacement sensor 181, the bias controller 182 sets the bias value of the bias power supply 121 to a level lower than the standard bias thereby to turn ON the bias power supply 121 in this state.

At this time, the discharged ions, as generated between the discharge electrode member 110 and the conveyor belt 80, take a level lower than the standard level. Since the discharge electrode member 110 and the sheet separating portion SP approach each other according to a change in the separation position of the sheet 25, the discharged ions, as generated between the discharge electrode member 110 and the conveyor belt 80, are reliably fed to the vicinity of the sheet separating portion SP of the sheet 25.

Here in this embodiment, the bias value of the bias power supply 121 is variably set on the basis of the detection signal coming from the displacement sensor 181. However, this embodiment and Embodiment 3 may be combined, for example, to feed back the position of the discharge electrode member 110 by the electrode position controller 161 on the basis of the detection signal coming from the displacement sensor 181.

By combining this embodiment and Embodiment 4 suitably, on the other hand, the bias value from the bias power supply 121 may be variably set on the basis of the environmental data.

[Embodiment 6]

Figure 22:
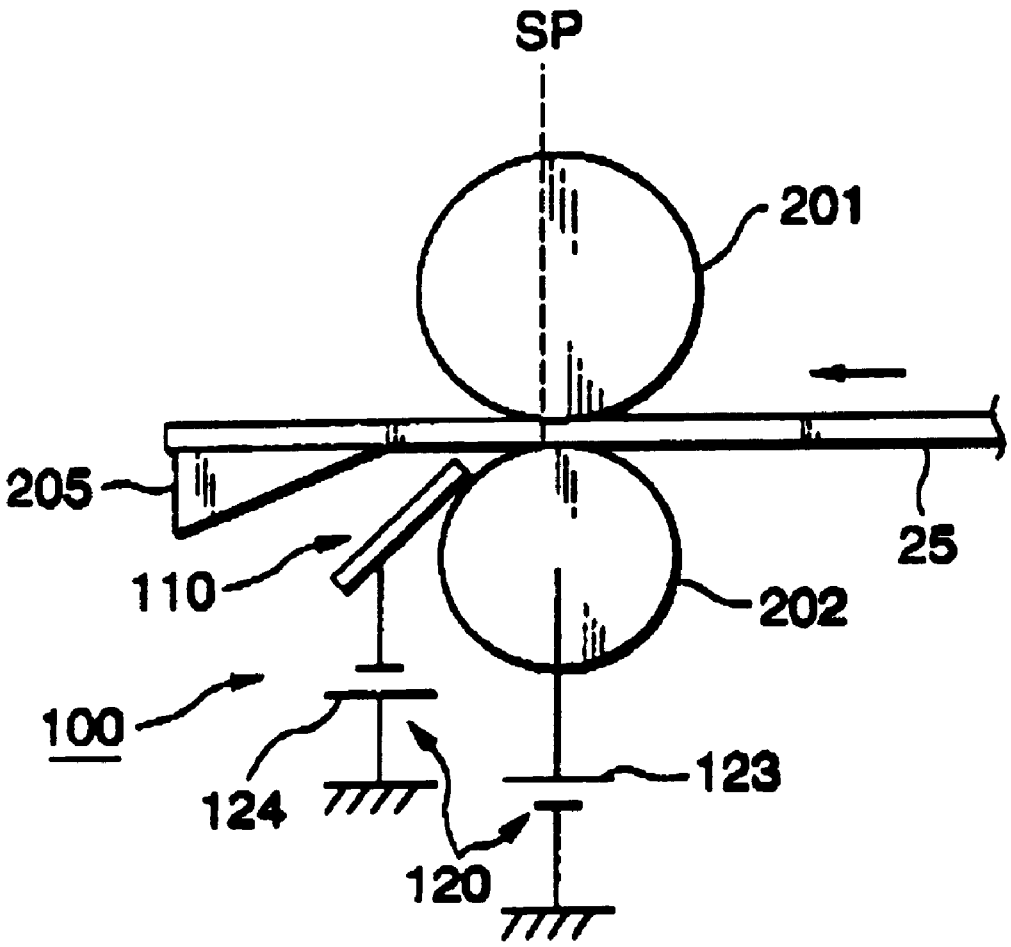
FIG. 22 is an explanatory diagram showing an essential portion of an image forming apparatus according to Embodiment 6.

FIG. 22 shows a summary of Embodiment 6 of the image forming apparatus according to the invention.

In FIG. 22, the image forming apparatus is provided, unlike Embodiments 1 to 5, with: a photosensitive drum 201 for forming and carrying a toner image (including not only a monochromatic image but also a color image) at the negative polarity, for example, by the not-shown electrophotography device; and a transfer roll 202 arranged to confront the photosensitive drum 201 thereby to nip and convey the sheet 25 and transfer the toner image on the photosensitive drum 201 electrostatically to the sheet 25.

In this embodiment, the transfer roll 202 is constructed by forming a (not-shown) highly resistive elastic layer of 5 to 10 logohms on the surface of a metallic roll body of SUS (or stainless steel).

Downstream of the nipping region of the photosensitive drum 201 and the transfer roll 202, moreover, there are disposed the sheet separation aiding device 100 and a guide chute 205 for guiding the sheet 25. Here in this embodiment, the exit end of the nipping region of the photosensitive drum 201 and the transfer roll 202 provides the sheet separating portion SP.

In this embodiment, the sheet separation aiding device 100 is equipped with the discharge electrode member 110 arranged to confront the transfer roll 202, and the bias applying unit 120 for establishing the discharge between the discharge electrode member 110 and the transfer roll 202.

Here, the construction and layout of the discharge electrode member 110 are set substantially similar to those of Embodiment 1. On the other hand, the bias applying unit 120 is constructed by connecting a bias power supply 123, to which the transfer bias at the polarity reversed from the toner polarity is applied, with the transfer roll 202 and by connecting an auxiliary bias power supply 124, to which the auxiliary bias (constructing a separation aiding bias together with the transfer bias) at the same polarity as the toner polarity is applied, with the discharge electrode member 110.

Here will be described the actions of the image forming apparatus according to this embodiment.

Now, it is assumed that the not-shown toner image is formed on the photosensitive drum whereas the sheet 25 has passed through the nipping region between the photosensitive drum 201 and the transfer roll 202.

At this time, when the bias power supply 123 and the auxiliary bias power supply 124 are turned ON, the transferring electric field is established between the photosensitive drum 201 and the transfer roll 202 so that the toner image on the photosensitive drum 201 is transferred to the sheet 25.

On the other hand, the discharge also occurs between the transfer roll 202 and the discharge electrode member 110 so that the discharged ions are fed to the vicinity of the sheet separating portion SP. As a result, the separation discharge at the separation time of the sheet 25 is suppressed to effectively suppress the toner dispersion, as might otherwise be caused by the separation discharge, of the toner image on the sheet 25.

It is especially noted in this embodiment that the deterioration of the intrinsic transfer action by the transfer roll 202 is reliably avoided by establishing the discharge between the transfer roll 202 and the discharge electrode member 110.

Figure 23:
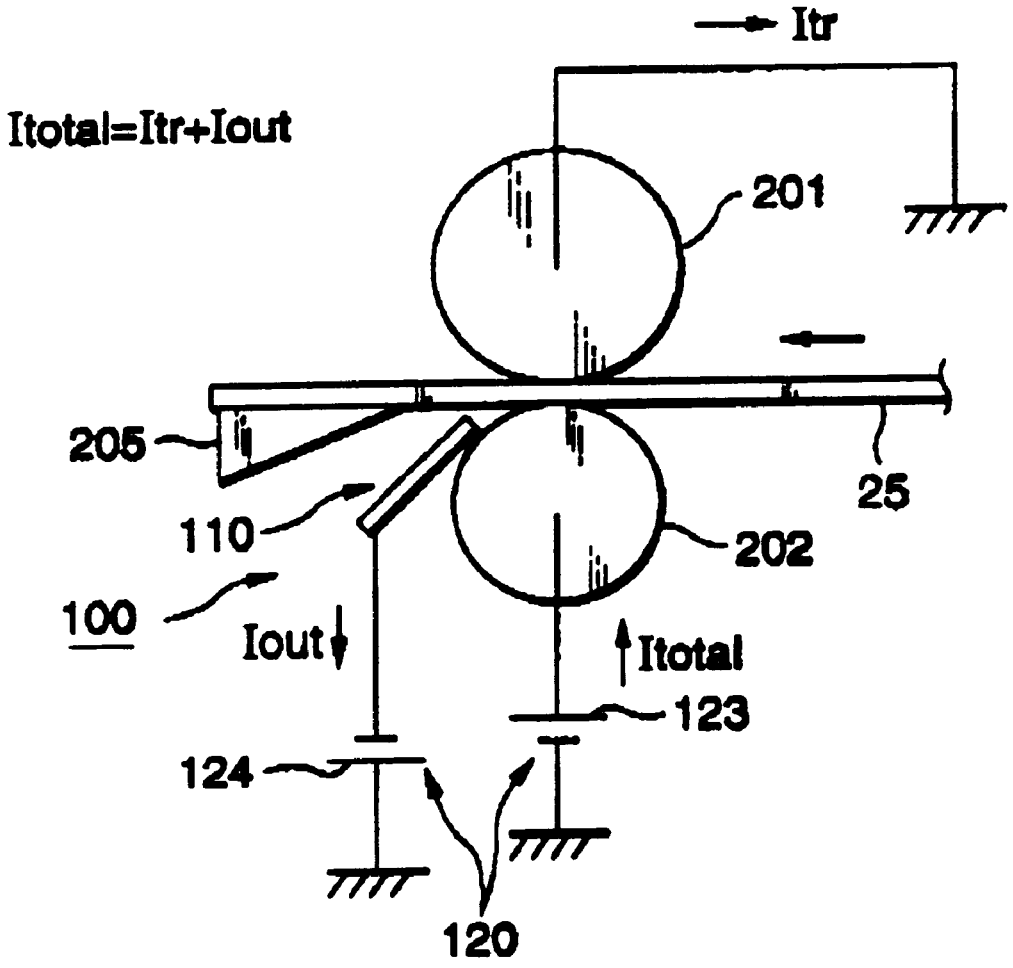
FIG. 23 is an explanatory diagram showing a condition for using the image forming apparatus according to Embodiment 6.

The bias power supply 123 and the auxiliary bias power supply 124 have to be constructed to satisfy such requirement. In this embodiment, as shown in FIG. 23, in order that the discharging action by the discharge electrode member 110 and the transferring action by the transfer roll 202 may not influence each other by their interactions, there is adopted a method (Itotal=Itr+Iout). In this method, a transfer current value Itotal to be injected into the transfer roll 202 is controlled to a constant current by the bias power supply 123, and a discharge current value Iout to flow into the discharge electrode member 110 is controlled to a constant current by the auxiliary bias power supply 124 to regulate the discharge current Iout to flow from the transfer roll 202 to the discharge electrode member 110 thereby to control an effective value Itr of the transfer current to flow from the transfer roll 202 toward the photosensitive drum 201.

[Embodiment 7]

Figure 24:
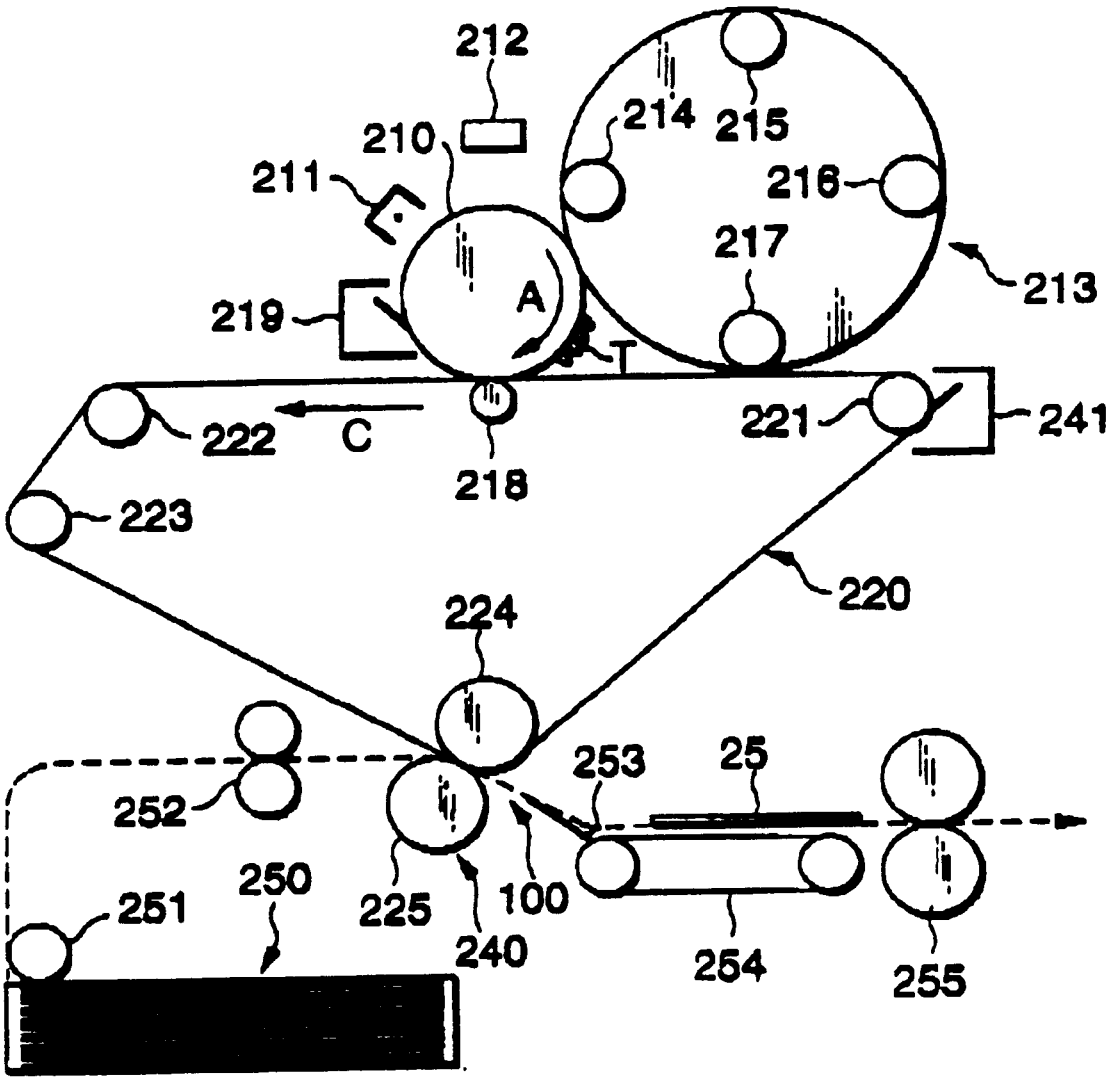
FIG. 24 is an explanatory diagram showing an essential portion of an image forming apparatus according to Embodiment 7.

FIG. 24 shows a summary of Embodiment 7 of the image forming apparatus according to the invention.

In FIG. 24, reference numeral 210 designates a photosensitive drum (or latent image carrier) which is rotated in the direction of arrow A so that an electrostatic latent image according to graphic data is formed on the surface of the photosensitive drum 210 by the well-known electrophotographic process of a charge unit 211 and an exposure unit 212 such as a laser scanning unit.

Around this photosensitive drum 210, on the other hand, there is arranged a rotary developing unit 213, in which developers 214 to 217 for the individual colors of black (Bk), yellow (Y), magenta (M) and cyan (C) colors are mounted in the rotary holders, so that the electrostatic latent images, as formed on the photosensitive drum 210, are developed by any of the developers 214 to 217 to form a toner image T.

Here, numeral 219 designates a drum cleaner for eliminating the residual toner on the photosensitive drum 210.

On the other hand, numeral 220 designates an intermediate transfer belt (or intermediate transfer member) arranged to abut against the surface of the photosensitive drum 210. This intermediate transfer belt 220 is driven on a plurality of (or four in this embodiment) rolls 221 to 224 to turn in the direction of arrow C.

Here in this embodiment: numeral 221 designates a drive roll of the intermediate transfer belt 220; numeral 222 a driven roll; numeral 223 a tension roll for controlling the tension of the intermediate transfer belt 220 to a constant; and numeral 224 an opposed roll (or backup roll) for a secondary transfer.

In this embodiment, on the other hand, the intermediate transfer belt 220 is made by introducing a suitable amount of carbon black or the like into a resin such as polyimide, polycarbonate, polyester, polypropylene or polyethylene terephthalate or a variety of rubbers, to have a volume resistivity of $10^5$ to $10^{14}$ ohms and a thickness of 0.1 mm, for example.

In the portion (or a primary transfer position), as confronting the photosensitive drum 210, of the intermediate transfer belt 220, moreover, there is arranged on the back side of the intermediate belt 220 a primary transfer unit (or a bias roll in this embodiment) 218. When this bias roll 218 is fed with a voltage at the polarity reversed from the charged polarity of the toner, the toner image T on the photosensitive drum 210 is electrostatically attracted by the intermediate transfer belt 220.

At a secondary transfer position, as confronting the conveyor passage of the sheet 25, of the intermediate transfer belt, still moreover, there is arranged a secondary transfer unit 240. In this embodiment, the secondary transfer unit 240 is equipped with: a bias roll 225 arranged in forced contact with the toner image carrying face side of the intermediate transfer belt 220; and the opposed roll (or backup roll) 224 arranged on the back side of the intermediate transfer belt 220 to provide an opposed electrode for the bias roll 225.

Figure 25:
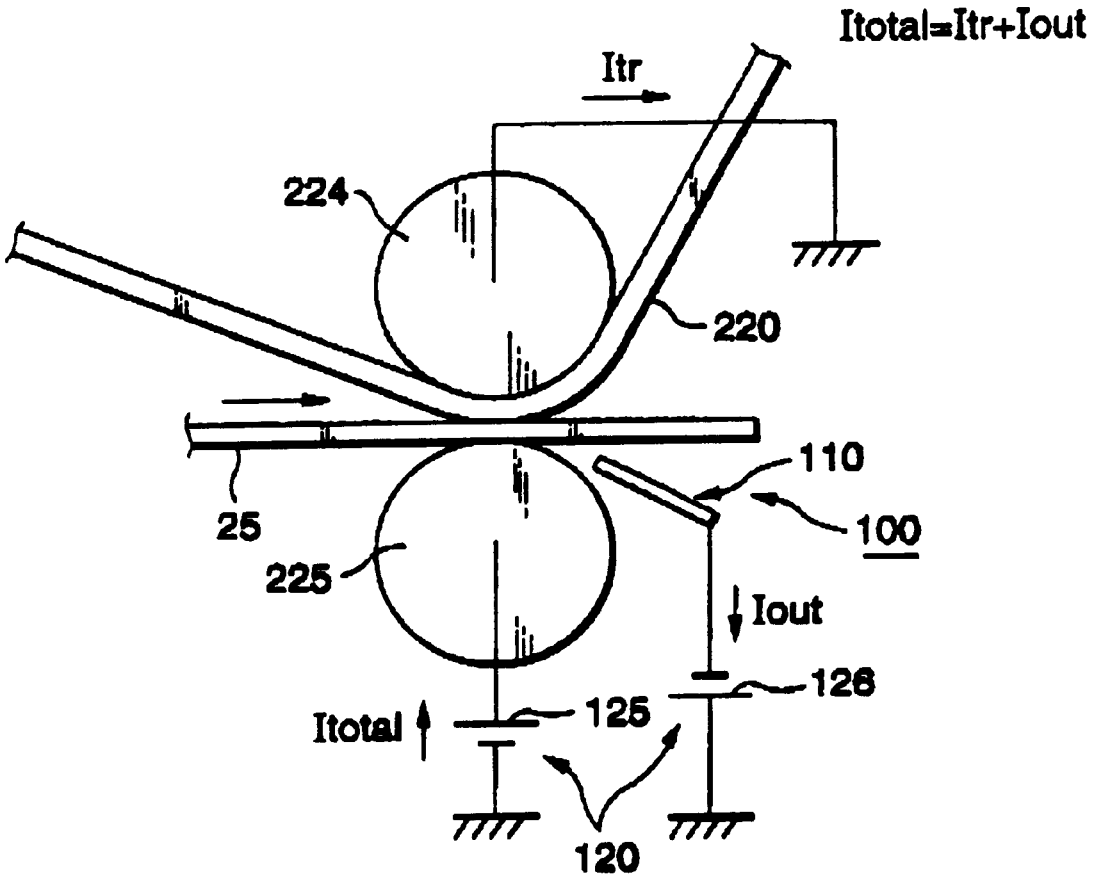
FIG. 25 is an explanatory diagram showing a condition for using the image forming apparatus according to Embodiment 7.

In this embodiment, moreover, the backup roll 224 is grounded to the earth, as shown in FIG. 25, and a bias at the polarity reversed from the charged polarity of the toner is stably applied to the bias roll 225.

Downstream of the secondary transfer unit 240, on the other hand, there is disposed a belt cleaner 241 for eliminating the residual toner on the intermediate transfer belt 220.

In this embodiment, on the other hand, on the sheet conveyor line, the sheet 25 from a sheet tray 250 is delivered by a feed roll 251 and is once positioned and stopped by a registration roll (or resist roll) 252 so that it is then delivered at a predetermined timing to a secondary transfer position. The sheet 25 after the secondary transfer is guided through a guide chute 253 onto a guide conveying belt 254, by which it is conveyed to a fixing unit 255.

Especially in this embodiment, the sheet separation aiding device 100 is arranged downstream of the nipping region of the bias roll 225 and the backup roll 224 in the secondary transfer unit 240 and at this side of the guide chute 253. Here in this embodiment, the exit end of the nipping region of the bias roll 225 and the backup roll 224 provides the sheet separating portion SP.

As shown in FIG. 25, this sheet separation aiding device 100 is equipped with the discharge electrode member 110 arranged to confront the bias roll 225, and the bias applying unit 120 for establishing the discharge between the discharge electrode member 110 and the bias roll 225.

Here, the discharge electrode member 110 has a construction and a layout substantially similar to those of Embodiment 1. On the other hand, the bias applying unit 120 is constructed by connecting a bias power supply 125, to which a secondary transfer bias (also acting as the separation aiding bias) at the polarity reversed from the toner polarity is applied, with the bias roll 225 and by connecting an auxiliary bias power supply 126, to which an auxiliary bias (constructing the separation aiding bias together with the aforementioned transfer bias) at the same polarity as the toner polarity is applied, with the discharge electrode member 110.

Here will be described the actions of the image forming apparatus according to this embodiment.

Now, it is assumed that the toner images of the individual color components are formed on the photosensitive drum 210 and are sequentially transferred to the intermediate transfer belt 220, and that the sheet 25 has passed through the secondary transfer portion.

At this time, when the bias power supply 125 and the auxiliary bias power supply 126 are turned ON, the transferring electric field is established between the bias roll 225 and the backup roll 224 so that the toner images on the intermediate transfer belt 220 are transferred to the side of the sheet 25.

On the other hand, the discharge also occurs between the bias roll 225 and the discharge electrode member 110 so that the discharged ions are fed to the vicinity of the sheet separating portion SP. As a result, the separation discharge at the separating time of the sheet 25 is suppressed to effectively suppress the toner dispersion, as might otherwise be caused by the separation discharge, of the toner images on the sheet.

What is especially noted in this embodiment is that the deterioration of the intrinsic transfer action by the bias roll 225 and the backup roll 224 is reliably prevented by causing the discharge between the bias roll 225 and the discharge electrode member 110.

The bias power supply 125 and the auxiliary bias power supply 126 have to be constructed to satisfy such requirement. In this embodiment, as shown in FIG. 25, in order that the discharging action by the discharge electrode member 110 and the transferring actions by the bias roll 225 and the backup roll 224 may not influence each other by their interactions, there is adopted a method. In this method, the transfer current value Itotal to be injected into the bias roll 225 is controlled to a constant current by the bias power supply 125, and the discharge current value Iout to flow into the discharge electrode member 110 is controlled to a constant current by the auxiliary bias power supply 126 to regulate the discharge current Iout to flow from the bias roll 225 to the discharge electrode member 110 thereby to control the effective value Itr of the transfer current to flow from the transfer roll 202 toward the backup roll 224.

EXAMPLES

Example 1

Figure 26:
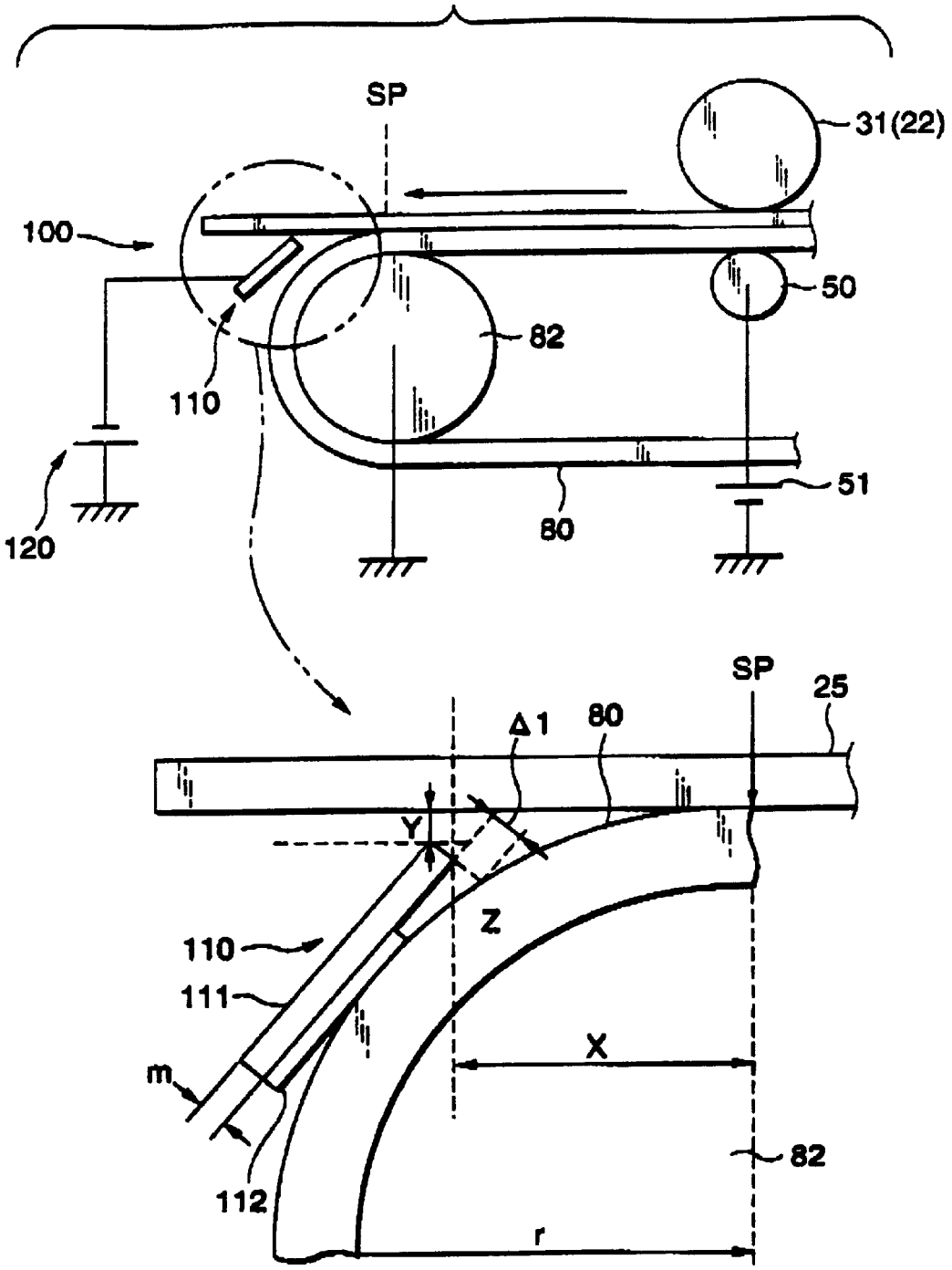
FIG. 26 is an explanatory diagram showing an experimental model to be used in Examples.

In the color image forming apparatus (i.e., a tandem type color image forming apparatus: the sheet conveyance type) according to Embodiment 1, the extent of preventing the image quality deterioration due to the toner dispersion at the sheet separation time was examined by using an experimental model shown in FIG. 26.

Here, the experimental conditions and the experimental parameters are as follows:

Experimental Environment:
- Low Moisture Environment of 15%

Conveyor Belt Resistance:
- Volume Resistivity of 8.5 logohms (Low Moisture Environment of 15%)
- Surface Resistivity of 10.5 logohms (Low Moisture Environment of 15%)

Apparatus Parameters m (Thickness of Metal Plate [Discharge Electrode Plate]): 100 $\mu$s r (Distance from Tension Roll Center to Conveyor Belt): 7.5 mm Δ1 (Distance between Leading edge of Discharge Electrode Plate and Conveyor Belt): 50 to 100 microns X (Distance from Tension Roll Center to Discharge Electrode Plate): 3 mm Y (Distance from Sheet Back Side to Discharge Electrode Plate): 1 mm Z (Protrusion [Uninsulated Portion] of Discharge Electrode Plate): 500 microns.

The experimental results are tabulated in FIG. 27.

In FIG. 27, the applied current value indicates the discharge current value which was applied in the experiments for the constant current control. On the other hand, the monitor voltage indicates the applied voltage of the bias power supply 121.

In FIG. 27, the effect was evaluated at three stages Δ, O-, and O on the improvements in the image quality deterioration due to the toner dispersion. The symbol Δ indicates that the image quality deterioration due to the toner dispersion was better than that of the case of no sheet separation aiding device; the symbol O indicates an unstable effect in which the image quality deterioration due to the toner dispersion was little but partially found; and the symbol O indicates a stable effect in which the image quality deterioration due to the toner dispersion was not found in the least.

According to FIG. 27, it is understood that the more ions were discharged at the higher current of the discharge so that the improvements in the image quality deterioration due to the toner dispersion were stabilized.

Example 2

Figure 28:
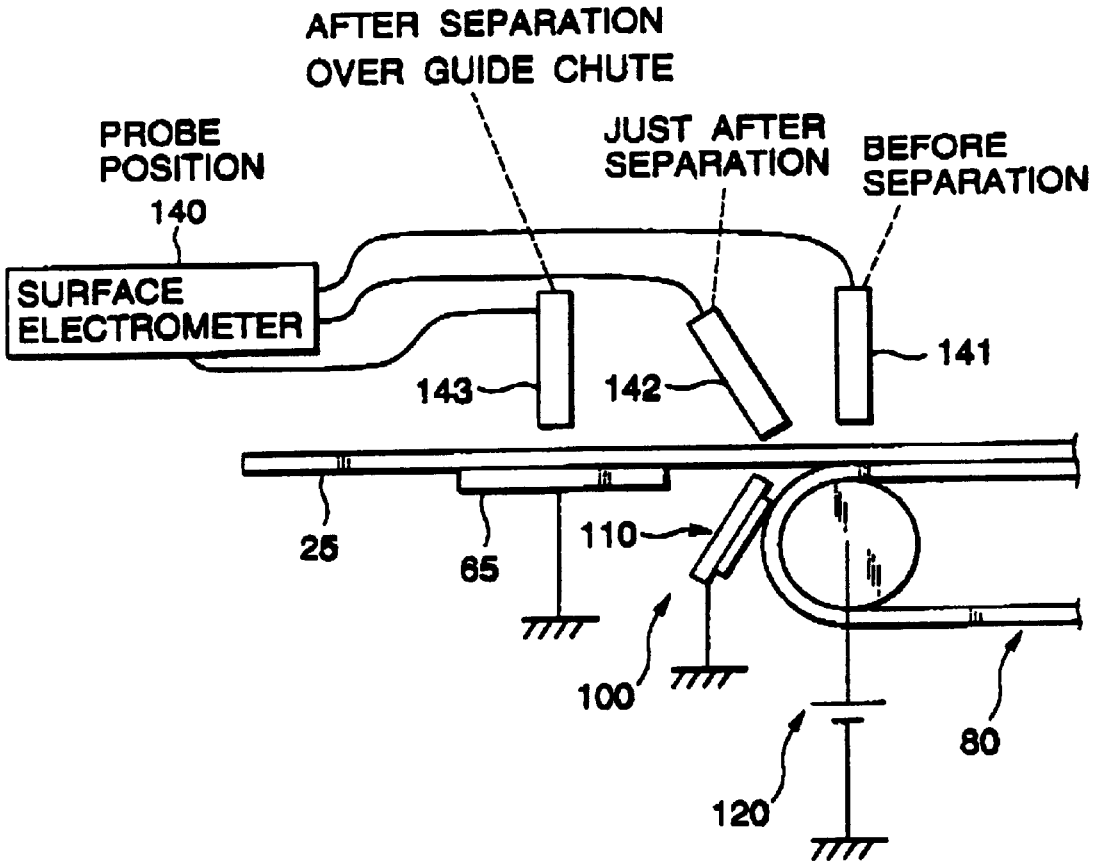
FIG. 28 is an explanatory diagram showing an experimental model for examining the changes in a sheet charge.

In the color image forming apparatus (i.e., a tandem type color image forming apparatus: the sheet conveyance type) according to Embodiment 1, the charge change of the sheet (of paper in this experiment) in the sheet separation process was examined by using an experimental model shown in FIG. 28.

Here in the experimental model of FIG. 28, the probes 141, 142 and 143 of a surface electrometer 140 were arranged at positions corresponding to the guide chute 65 before the sheet separation, immediately after the sheet separation and after the sheet separation, respectively. With or without the sheet separation aiding device 100, the sheet 25 was separated from the conveyor belt 80, and the charge changes on the guide chute 65 on the surface side of the sheet 25 was measured individually before the sheet separation, immediately after the sheet separation and after the sheet separation.

Figure 29:
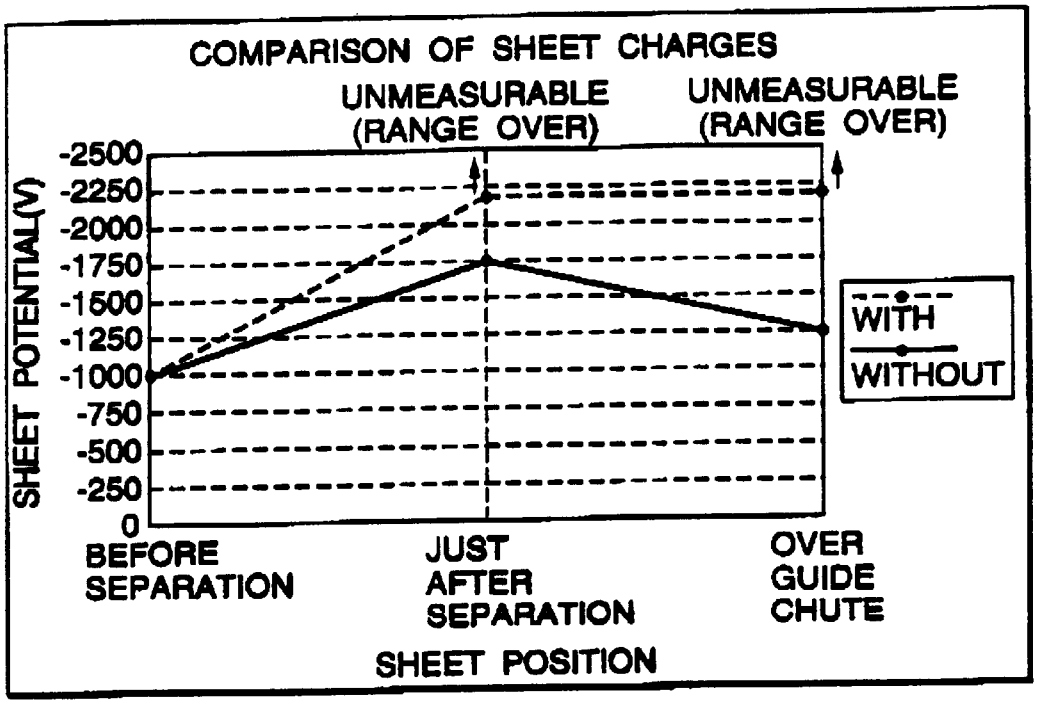
FIG. 29 is a graph plotting relations between the positions for measuring the charge of a sheet and the quantity of sheet charge.
Figure 30:
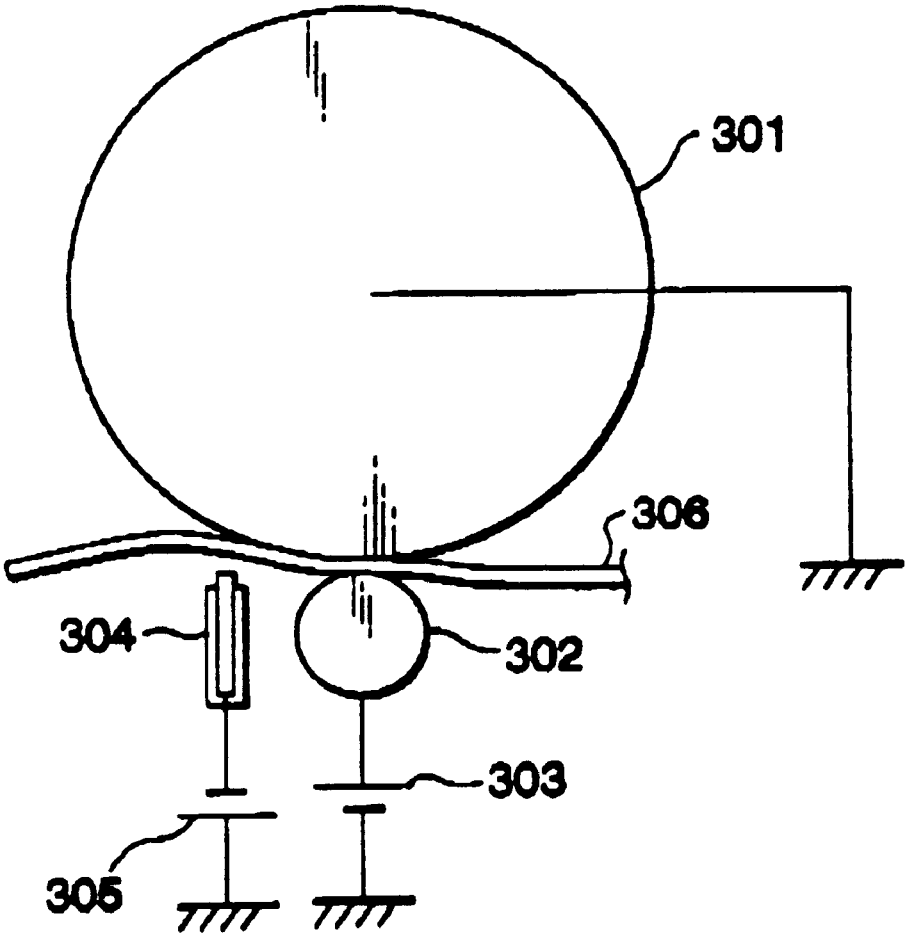
PRIOR ART FIG.30
FIG. 30 is an explanatory diagram showing one example of an image forming apparatus in the prior art.

Without using the sheet separation aiding device 100 according to this experimental model, as shown in FIG. 29, the charges of the sheet 25 on the guide chute 65 immediately after and after the sheet separation could not be measured (i.e., the state exceeding the measurable range of −2,200 V of this example). With the use of the sheet separation aiding device 100, on the other hand, it is also understood that the charges on the surface side of the sheet 25 on the guide chute 65 were reliably eliminated immediately after and after the sheet separation.

It is therefore under stood that the separation discharge hardly occurred at the separation time of the sheet 25.

According to the invention, as has been described hereinbefore, the discharge electrode member capable of discharging between itself and the sheet conveyor of the conveyance/transfer unit is arranged as the sheet separation aiding unit on the downstream side of the sheet separating portion of the sheet conveyor and the discharge is established between the discharge electrode member and the sheet conveyor so that the discharged ions are fed to the vicinity of the sheet separating portion. As a result, both the back face of the sheet in the vicinity of the sheet separating portion and the surface of the sheet conveyor can be homogeneously destaticized so that the separation discharge at the sheet separating time can be more effectively suppressed to prevent the image quality deterioration due to the toner dispersion, as caused by the separation discharge, more effectively.

What is claimed is:

1. An image forming apparatus for use with a sheet, comprising: an image carrier for carrying a toner image; a conveyance/transfer unit including at least a sheet conveyor for holding and convey the sheet, for transferring the toner image on said image carrier electrostatically to the sheet; and a sheet separation aiding unit for aiding the action of separating the sheet from said sheet conveyor, wherein said sheet separation aiding unit includes: a discharge electrode member arranged downstream of a sheet separating portion of said sheet conveyor and at a position that discharges ions between itself and said sheet conveyor; so as not to substantially affect the toner image and a bias applying unit for discharging between said discharge electrode member and said sheet conveyor, and wherein the discharged ions, as generated from said discharge electrode member, are fed to the vicinity of the sheet separating portion of said sheet conveyor.

2. The image forming apparatus according to claim 1, wherein the sheet conveyor of said conveyance/transfer unit is arranged in contact with said image carrier to hold and convey said sheet and acts as a transfer member for transferring the toner image on said image carrier to the side of said sheet.

3. The image forming apparatus according to claim 1, wherein the sheet conveyor of said conveyance/transfer unit has a volume resistivity of 5 to 14 logohms.

4. The image forming apparatus according to claim 1, wherein said discharge electrode member is arranged in contact with said sheet conveyor through an insulating member.

5. The image forming apparatus according to claim 1, wherein said sheet conveyor includes a curved portion having an arcuate section downstream of said sheet separating portion, and wherein said discharge electrode member is arranged to confront said curved portion at an angle ranging within 90 degrees from the sheet separating portion of said sheet conveyor.

6. The image forming apparatus according to claim 1, wherein said sheet conveyor includes a curved portion having an arcuate section downstream of said sheet separating portion, and wherein at least a portion of said discharge electrode member is arranged within a wedge region which is formed between the sheet, as separated at the sheet separating portion of said sheet conveyor, and the curved portion of said sheet conveyor.

7. The image forming apparatus according to claim 1, further comprising:

an air outflow unit for moving the discharged ions, as generated from the discharge electrode member, forcibly with an air flow.

8. The image forming apparatus according to claim 1, wherein said discharge electrode member includes a tracking member for retaining a dischargeable gap between itself and said sheet conveyor.

9. The image forming apparatus according to claim 1, wherein said discharge electrode member includes a guide member for guiding and conveying the sheet which is separated at the sheet separating portion of said sheet conveyor.

10. The image forming apparatus according to claim 1, wherein said discharge electrode member is set variable at its arranged position.

11. The image forming apparatus according to claim 1, wherein said bias applying unit applies a discharge bias at the polarity reversed from that of the toner on the side of said sheet conveyor.

12. The image forming apparatus according to claim 1, wherein said bias applying unit shares a bias to be applied to another functional member other than said discharge electrode member.

13. The image forming apparatus according to claim 1, wherein the sheet has an image region; and said bias applying unit applies a bias at a timing corresponding to the passage of at least the image region on said sheet through the sheet separating portion of said sheet conveyor.

14. The image forming apparatus according to claim 1, wherein the sheet has an image region; and a leading edge; and said bias applying unit applies a bias at a timing corresponding to the passage of at least the image region on said sheet and the leading edge of said sheet through the sheet separating portion of said sheet conveyor.

15. The image forming apparatus according to claim 1, further comprising:

wherein residual toner is produced when transferring the toner image on said image carrier electrostatically to the sheet;

a sheet conveyor cleaner for cleaning the residual toner on said sheet conveyor by applying a bias at the polarity reversed from that of said toner to a cleaning member, wherein said bias applying unit applies the bias for said discharge electrode member to discharge the residual toner on said sheet conveyor at the action time of said sheet conveyor cleaner.

16. The image forming apparatus according to claim 1, wherein said bias applying unit sets variable a bias to be applied.

17. The image forming apparatus according to claim 1, further comprising:

a controller for controlling the discharge by said discharge electrode member in accordance with environmental conditions.

18. An image forming apparatus according to claim 17, wherein said controller includes an environment detecting unit for detecting whether or not the environment is in a low moisture where a sheet resistance becomes higher than a standard level, so that the discharge by said discharge electrode member may be effected only under the condition in which the detection data from said environment detecting unit is in said low moisture environment.

19. The image forming apparatus according to claim 1, further comprising:

a controller for controlling the discharge by said discharge electrode member in accordance with the kind or separation position of said sheet.

20. The image forming apparatus according to claim 19, wherein said controller includes a sheet data detecting unit for detecting the kind or separation position of said sheet, wherein the separation position of said sheet is defined according to the detection data coming from said sheet data detecting unit to set variable the discharge condition by said discharge electrode member.

* * * * *